US010954674B2

(12) United States Patent
Header

(10) Patent No.: US 10,954,674 B2
(45) **Date of Patent: *Mar. 23, 2021**

(54) HEATED SNOW GUARD

(71) Applicant: Gregory A Header, Richland, PA (US)

(72) Inventor: Gregory A Header, Richland, PA (US)

(73) Assignee: Gregory A. Header, Richland, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/929,231

(22) Filed: Feb. 24, 2020

(65) Prior Publication Data

US 2020/0190807 A1 Jun. 18, 2020

Related U.S. Application Data

(63) Continuation-in-part of application No. 15/974,582, filed on May 8, 2018, now Pat. No. 10,612,243.

(51) Int. Cl.

| | |
|---|---|
| ***E04D 13/10*** | (2006.01) |
| ***E04D 13/076*** | (2006.01) |
| ***H05B 3/06*** | (2006.01) |

(52) U.S. Cl.

CPC ..... *E04D 13/0762* (2013.01); *E04D 13/103* (2013.01); *H05B 3/06* (2013.01); *H05B 2214/02* (2013.01)

(58) Field of Classification Search

CPC ..... E04D 13/103; H05B 3/0033; H05B 2203/032; H05B 3/42

(Continued)

(56) References Cited

U.S. PATENT DOCUMENTS 756,884 A * 4/1904 Parry ..... E04D 13/10 52/25

2,546,743 A 3/1951 Harrison (Continued)

FOREIGN PATENT DOCUMENTS

CN 202599029 U 12/2012
CN 202852311 U 4/2013

(Continued)

OTHER PUBLICATIONS

Philips Infrared Lamp Catalog, Sep. 2004, Koninklijke Philips Electronics, N.V. Netherlands, downloaded from the Internet from https://www.interlightus.com/Catalogs/Philips/Philips%20Infra%20Red%20Lamps.pdf on Dec. 31, 2019.

(Continued)

*Primary Examiner* — Brian E Glessner
*Assistant Examiner* — Adam G Barlow
(74) *Attorney, Agent, or Firm* — Stone Creek Services LLC; Alan M Flum

(57) ABSTRACT

A snow guard assembly heated within one or more snow guard tubes. Heating of the snow guard tube prevents excessive accumulation of snow and helps prevent snow build up and spill over above the top of the snow guard. The tubes can be length-wise separable to place and service the heating elements. The heating element can be standard heat tape or infrared LEDs. The snow guard tubes can optionally have a non-uniform cross-sectional thickness to direct the heat more efficiently in a desired orientation. The interior of the snow guard tubes can be selectively coated with infrared absorbing or reflective material to direct the heat in a desired orientation when infrared LEDs are used as a heat source. The snow guard can be attached to many types of roof surfaces including tile roofs, metal roofs with or without standing seams, and shingle roofs.

15 Claims, 37 Drawing Sheets

(58) Field of Classification Search
USPC ..... 52/24–26; 219/213, 534, 535, 544, 553
See application file for complete search history.

(56) References Cited

U.S. PATENT DOCUMENTS

| | | | | |
|---|---|---|---|---|
| 2,699,484 | A | 1/1955 | Michaels | |
| 3,129,316 | A | 4/1964 | Glass et al. | |
| 3,431,972 | A | 3/1969 | Bernardi | |
| 3,617,691 | A * | 11/1971 | Toyooka | E04D 13/10 219/201 |
| 3,784,783 | A | 1/1974 | Gray | |
| 3,792,728 | A | 2/1974 | Bernardi | |
| 4,110,597 | A * | 8/1978 | Elmore | E04D 13/103 138/33 |
| 4,401,880 | A * | 8/1983 | Eizenhoefer | E04D 13/103 219/213 |
| 4,769,526 | A | 9/1988 | Taouil | |
| 5,271,194 | A * | 12/1993 | Drew | E04D 13/10 248/231.71 |
| 5,391,858 | A | 2/1995 | Tourangeau et al. | |
| 5,593,127 | A | 1/1997 | Lindberg | |
| 5,609,326 | A * | 3/1997 | Stearns | E04D 13/10 182/45 |
| 5,900,178 | A * | 5/1999 | Johnsen | E04D 13/0762 219/497 |
| 5,930,457 | A | 7/1999 | Tourangeau | |
| 6,054,692 | A * | 4/2000 | Hitomi | E01C 11/265 219/540 |
| 6,225,600 | B1 * | 5/2001 | Burris | E04D 13/0762 219/213 |
| 6,256,934 | B1 * | 7/2001 | Alley | E04D 13/10 52/24 |
| 6,348,673 | B2 | 2/2002 | Winters | |
| 6,708,452 | B1 * | 3/2004 | Tenute | E04D 13/0762 219/213 |
| 6,725,623 | B1 * | 4/2004 | Riddell | E04D 3/36 52/25 |
| 7,071,446 | B1 * | 7/2006 | Bench | E04D 13/103 219/211 |
| 7,140,152 | B2 * | 11/2006 | Thaler | E04D 13/10 52/25 |
| 8,476,558 | B2 | 7/2013 | Aussi et al. | |
| 8,607,509 | B2 | 12/2013 | Gurr | |
| 8,782,960 | B2 * | 7/2014 | Nark | H05B 3/06 52/13 |
| 8,946,601 | B2 | 2/2015 | Casey | |
| 9,045,907 | B2 | 6/2015 | Clark et al. | |
| 9,181,707 | B2 * | 11/2015 | Iannelli | E04D 13/0762 |
| 9,428,915 | B2 * | 8/2016 | Nark | E04D 13/103 |
| 9,765,526 | B2 | 9/2017 | Breyer et al. | |
| 2001/0045064 | A1 * | 11/2001 | Alley | E04D 13/10 52/25 |
| 2003/0066247 | A1 * | 4/2003 | Trevorrow | E04D 13/10 52/25 |
| 2005/0108952 | A1 * | 5/2005 | Trevorrow | E04D 13/10 52/25 |
| 2005/0139585 | A1 * | 6/2005 | Knappmiller | E04D 13/103 219/213 |
| 2007/0245636 | A1 * | 10/2007 | Ayer | E04D 13/10 52/24 |
| 2010/0024324 | A1 | 2/2010 | Meinzer | |
| 2011/0284516 | A1 | 11/2011 | Burda | |
| 2013/0319990 | A1 | 12/2013 | Casey | |
| 2014/0263267 | A1 | 9/2014 | Jenkins et al. | |
| 2016/0060871 | A1 | 3/2016 | Kulkarni et al. | |
| 2018/0216755 | A1 * | 8/2018 | Rumsey | F16L 3/02 |
| 2019/0345719 | A1 | 11/2019 | Header | |

FOREIGN PATENT DOCUMENTS

| | | | |
|---|---|---|---|
| CN | 203891359 | U | 10/2014 |
| CN | 105240651 | A | 1/2016 |
| DE | 102011079191 | A1 | 1/2013 |
| DE | 102012021298 | A1 | 2/2014 |
| EP | 2357295 | A1 | 8/2011 |
| GB | 758912 | A | 10/1956 |
| JP | 6047442 | U | 6/1994 |
| JP | H0647442 | U | 6/1994 |
| JP | 10140526 | A | 5/1998 |
| JP | 2966998 | B2 | 10/1999 |
| JP | 2002309729 | A | 10/2002 |
| JP | 2002339529 | A | 11/2002 |
| JP | 2004044234 | A | 2/2004 |
| JP | 2004225415 | A | 8/2004 |
| JP | 4059461 | B2 | 3/2008 |
| JP | 3141702 | U | 5/2008 |
| JP | 3141702 | U3 | 5/2008 |
| JP | 2009187707 | A | 8/2009 |
| JP | 5966170 | B1 | 8/2016 |
| JP | 6109109 | B2 | 4/2017 |
| KR | 101772604 | B1 | 6/2017 |

OTHER PUBLICATIONS

Technical information and support facilities, Philips infrared lamps, Apr. 2007, Koninklijke Philips Electronics, N.V. Netherlands, downloaded from the Internet from http://prolight.info/pdf_specs/Philips%20IR%20Technical%20brochure.pdf on Dec. 31, 2019.
Sno Gem Product Catalog 2017, Nov. 2017, Sno Gem, Inc., McHenry, Illinois.
Roof De-Ice Product Sheet, Sep. 2015, Calorique, West Wareham, Massachusetts.
S-5! SnoRail & SnowFence Components, May 2013, Metal Roof Innovations Ltd., Colorado Springs, Colorado.
S-5! ColorGard Components, May 2017, Metal Roof Innovations Ltd., Colorado Springs, Colorado.
S-5! DualGuard, Oct. 2016, Metal Roof Innovations Ltd., Colorado Springs, Colorado.
S-5! VersaGuard, May 2015, Metal Roof Innovations Ltd., Colorado Springs, Colorado.
S-5! X-Guard, Apr. 2017, Metal Roof Innovations Ltd., Colorado Springs, Colorado.
S-5! DualGuard Install, Oct. 2016, Metal Roof Innovations Ltd., Colorado Springs, Colorado.
S-5! SnowRail/SnoFence Install, Dec. 2015, Metal Roof Innovations Ltd., Colorado Springs, Colorado.
S-5! VersaGuard Install, Jan. 2016, Metal Roof Innovations Ltd., Colorado Springs, Colorado.
S-5! X-Guard Install, Mar. 2016, Metal Roof Innovations Ltd., Colorado Springs, Colorado.
ADKS Electric Roof De-Icing Cable Brochure, Dec. 2016, EGS Electrical Group LLC, Rosemont, Illinois.
Heat Channel Fitting Guide, Apr. 2013, Engineered Roof Deicing, Sandy, Utah.
HotEdge Rail Data Sheet, Jun. 2016, Sno Shield, Ammon, Indiana.
HotEdge HotDrip Data Sheet, Jun. 2016, Sno Shield, Ammon, Indiana.
HotEdge HotFlashing Data Sheet, Jun. 2016, Sno Shield, Ammon, Indiana.
HotEdge HotSeam Data Sheet, Jun. 2016, Sno Shield, Ammon, Indiana.
HotEdge HotShingleLok Data Sheet, Jun. 2016, Sno Shield, Ammon, Indiana.
HotEdge HotValley Data Sheet, Jun. 2016, Sno Shield, Ammon, Indiana.
Roof and Gutter De-Icing Cable Design and Installation Guide, Mar. 2014, Heat Trace Specialists, North Salt Lake, Utah.
Roof Ice Melt—Rim System (Raychem-DG-H59561), Sep. 2017, Pentair Thermal, Houston, Texas.
Roof Ice Melt (Rim) System for Concealed Roof & Gutter De-Icing (Raychem-DS- H59940), Sep. 2017, Pentair Thermal, Houston, Texas.
Raychem RIM-E Eave Panel System for Concealed Roof & Gutter De-Icing (DS-H59989), Dec. 2016, Pentair Thermal, Houston, Texas.

(56) References Cited

OTHER PUBLICATIONS

Raychem RIM-V Valley Panel System for Concealed Roof & Gutter De-Icing (DS-H59991), Dec. 2016, Pentair Thermal, Houston, Texas.
Raychem RIM-C Channel Panel System for Concealed Roof & Gutter De-Icing (DS-H59992), Dec. 2016, Pentair Thermal, Houston, Texas.
Raychem RIM-SC Snow Melt Concealed Panel System for Concealed Roof & Gutter De-Icing (DS-H59994), Dec. 2016, Pentair Thermal, Houston, Texas.
Raychem Roof and Gutter De-Icing Systems for Commercial Buildings (SB-H81855), Jul. 2016, Pentair Thermal, Houston, Texas.
Raychem Roof Ice Melt Systems (SB-H81694), Aug. 2016, Pentair Thermal, Houston, Texas.
Roof Deicing, May 2017, Heatizon Systems, Murray, Utah.
Snobar Product Brochure, Jan. 2012, Riddle and Company, Castle Rock, Colorado.
Delta-Therm Snow Melt Mats, Apr. 2016, Crystal Lake, Illinois.
Ice Melt Systems, Springrock LLC, Woodridge, Illinois, downloaded from the Internet from http://www.springrockgutters.com/ice-melt-systems.html on Dec. 7, 2017.
DGS Series (Filtered Short-Wave) Electric Infrared Heater, Mar. 2016, Detroit Radiant Products Company, Warren, Michigan.
Fortoria Mul-T-Mount Quartz Lamp Comfort Heaters, InfraredHeaters.com web page, NPL2 downloaded from the Internet from https://www.infraredheaters.com/fostor.html on Dec. 13, 2017.
Arduino Snow Depth Remote Sensing with Ultrasonic Sensor and ESP8266, downloaded from the Internet from: https://www.geekstips.com/arduino-snow-depth-remote-sensing-with-ultrasonic-sensor/ on Apr. 28, 2018.
Erica L. Corral, Alicia Ayala, Ronald E. Loehman, Raja Shah, Markus Reiterer, Denise Bencoe, Tape Casing of Magnesium Oxide, Sandia Report SAND2008-0528, Feb. 2008, Sandia National Laboratories, Albuquerque, New Mexico.
PipeGuard CMH Constant-Wattage, Metallic-Sheathed, High-Temperature Heating Cable, Publication No. HD100318-1 Rev 7, Apr. 2016, Dexan Energy Systems, Inc., Kelowna, BC, Canada.
3M Thermally Conductive Adhesive Transfer Tapes 8805 . 8810. 8815 . 8820, Publication No. 78-6900-9998-7, Jul. 2015, 3M Electronics Materials and Solutions Division, Saint Paul, Minnesota.
PN:7031 Infrared LED Strip Lights, Document No. CS_7031, Revision 1.1, Jun. 26, 2019, Waveform Lighting, San Francisco, California.
The IR Focus technology, Aug. 2015, downloaded from the Internet from https://www.physicsforums.com/attachments/ir-focus-technology-1-pdf on Dec. 24, 2019.
Kwesi Mensah and Jong Min Choi, Review of technologies for snow melting systems, Journal of Mechanical Science and Technology, 29 (12) (2015), Dec. 2015, pp. 5507-55021, Springer Publishing, New York, NY.
Infrared Heater, Wikipeda, Wikimedia Foundation, San Francisco, California, downloaded from the Internet from https://en.m.wikipedia.org/wiki/Infrared_heater on Dec. 31, 2019.
What is Far Infrared? Downloaded from the Internet from https://user.xmission.com/~total/temple/Soapbox/Articles/WhyFIR.html on Dec. 31, 2019.
Cathal Wilson and Gerard Mcgranaghan, Infrared heating comes of age (Part 1), Mar. 4, 2019, Materials Today, downloaded from the Internet from https://www.materialstoday.com/composite-processing/features/infrared-heating-comes-of-age-part-1/ on Dec. 31, 2019.
Cathal Wilson and Gerard Mcgranaghan, Infrared heating comes of age (Part 12), Mar. 25, 2019, Materials Today, downloaded from the Internet from https://www.materialstoday.com/composite-processing/features/infrared-heating-comes-of-age-part-2/ on Dec. 31, 2019.
Metal Infrared Heaters, downloaded from the Internet from https://www.infraredheaters.com/metal1.html on Dec. 31, 2019.
Framed Aluminium White Infrared Heating Panels, Healthy Heat, downloaded from the Internet from https://healthy-heat.com/products/aluminium-infrared-heating-panels/ on Dec. 31, 2019.
Infrared Heating Technology, Healthy Heat, downloaded from the Internet from https://healthy-heat.com/infrared-heating/ on Dec. 31, 2019.
Far-infrared Snow-melting Device/TOKERUMO, Elcom Co., Ltd., downloaded from the Internet from https://www.elcom-jp.com/english/products/tokermo/tokermo.html on Dec. 31, 2019.
Types of Infrared Heater, downloaded from the Internet from https://www.herschel-infrared.com/how-it-works/types-infrared-heater/ on Dec. 31, 2019.
Dan MacIsaac and Graydon Anderson, Basic Physics of the Incandescent Lamp (Lightbulb), The Physics Teacher, vol. 37, Dec. 1999, p. 524, downloaded from the Internet from http://physlab.org/wp-content/uploads/2016/03/Planck_ref8.pdf on Dec. 31, 2019.

* cited by examiner

HEATED SNOW GUARD

CROSS-REFERENCE TO RELATED APPLICATIONS

This application is a continuation-in-part of application Ser. No. 15/974,582, filed May 8, 2018.

BACKGROUND

This disclosure relates to snow retention devices attached to roofs. Specifically, this disclosure relates to snow guards.

Snow guards are snow retention devices designed to prevent snow and ice from avalanching off roofs. Snow guards are different from roof edge deicing systems. Roof edge deicing systems use heated pads, heated membranes, or heated cables, mounted flush or below the roof shingles, tiles, or other metal roof surface, at the roof edge. Their purpose is to prevent heavy ice, or ice dams, caused by snow melting and re-freezing at the warmer roof edge from accumulating at either the roof edge or gutter. In contrast, snow guards are snow retention devices mounted above the roof surface, typically away from the roof edge. Their purpose is to create a barrier, or create friction, to prevent snow from avalanching off a pitched (i.e., an angled) roof.

There are several types of snow guards. These include pad-style, pipe-style, and bar-style snow guards. Historically, these derive from two concepts for snow retention developed several hundred years ago. The first concept was to place stationary rocks on roofs to provide friction and prevent snow from sliding down the roof slope. The second concept was to position logs on the roof parallel to, but away from, the roof edge to act as a fence or barrier for snow and ice. Pad-style snow guards are analogous to placing stationary rocks on the roof surface. Pipe-style and bar-style snow guards are analogous to placing logs parallel to, but away from, the roof edge.

Pad-style snow guards, typically comprise individual projections, cleats, or pads that project above the roof surface. Their purpose is to provide friction and prevent snow and ice from sliding down a sloped roof.

Pipe-style snow guards use one or more enclosed pipes or tubes positioned above the roof surface to create a barricade for snow to accumulate. The pipes or tubes are often positioned above the roof surface by brackets, seam clamps, or mounting devices depending on the type of roof. The pipes or tubes are typically positioned parallel to the length-wise edge of the roof. More than one pipe or tube can be positioned above one another to act like a fence or barrier for snow. The pipes or tubes are typically placed well away from the roof edge so if snow accumulates and spills over the top of the snow guard, it is less likely to avalanche over the edge of the roof.

Bar-style are like pipe-style snow guards except vertical bars or open L-brackets are used in place of enclosed pipes or tubes. Both bar-style and pipe-style snow guards are often collectively called snow guard rail systems.

SUMMARY

The inventor noted that one problem with snow guards is that in unexpected large storms or long cold winters, snow may accumulate beyond the capacity of the snow guard and spill over the top of snow guard tubes.

The inventor reasoned that he could heat the snow guard tubes to prevent excess accumulation of snow and melt ice and snow gradually to prevent large amounts of snow and ice falling all at once. The inventor discovered that he could direct the heat energy to optimize snow melt. The inventor found several ways, that could be used alone or in combination, to direct the heat. These include the following. First, he could use infrared light emitting diodes (LEDs), radiant infrared emitters, or other infrared heating or lights sources and direct the heat by directing the infrared light. Second, he could vary the wall thickness of the snow guard tube to direct the heat. Third, he could create a multi-chamber snow guard tube with one or more heating elements (e.g. heating tape in one chamber, and infrared LEDs in the other chamber). The multi-chamber snow guard tube could optionally have a heating element in one chamber isolated from a heat storage material in the other chamber. Fourth, he could create an infrared absorbing or reflective coating selectively applied to the snow guard tube in combination with an infrared light source to direct the heat.

To the inventor's knowledge, he is the first to use infrared LEDs as a heating element in a snow guard assembly. Infrared LEDs and infrared light sources are typically used where the infrared light can radiate outward into an open space. For example, infrared quartz heating elements are typically used in reflective room heaters. A reflective back surface, typically parabolic, projects the infrared light into either an interior or exterior space to heat a specific area. Arrays of infrared LEDs mounted against back reflective surfaces are similarly used to heat specific indoor or outdoor spaces. In addition, infrared LED in waterproof fixtures, combined with large blower fans, are used in automated car washes to dry water vehicles. In all these examples, the infrared LEDs are used to project infrared energy (i.e., infrared light) out into an exterior environment. Their fixtures are typically uncovered or covered with a material transparent to infrared light. The inventor discovered, contrary to popular wisdom, that he could advantageously apply infrared LEDs to an enclosed space where the surface enclosing the space is substantially opaque to infrared energy and/or visible light.

When switching between conduction type heating elements, and infrared heating elements differences between the two types of heating elements should be appreciated and is not simply substitution. Conduction type heating elements, like heat tape, heat trace cable, or heating wire, transfer heat by direct contact with a heat conductive medium. For example, direct conduction to a metal snow guard tube as well as heating the air space surrounding the heating element. Infrared heating elements, such as infrared LEDs, conduct waste heat through their diode junction and through radiating infrared radiation (i.e., infrared light) onto a heat conducting medium such as the snow guard tube. These differences can dictate design choices and are non-obvious. However, designing for each type of heating element or combinations of each should be clear from the examples described within this disclosure.

To make the snow guard easy to assemble and service, the inventor discovered that he could construct the snow guard tube so that the snow guard tube was length-wise separable into a first tube portion and a second tube portion. The inventor envisions that a wide range of structures can join the length-wise tube portions together. For example, the first tube portion and a second tube portion can snap together, can be hinged along one length-wise edges on side of the snow guard tube and snap together along the length-wise edges on the other side of the snow guard tube.

The inventor anticipates using his snow guard assembly in a wide range of roof styles. These include standing seam, shingle, shake, tile, metal, or concrete roofs. He also envisions the snow guard being used in transparent or translucent roofs, for example glass, acrylic, or polycarbonate roofs. The inventor envisions the snow guard assembly could include a mounting bracket to raise the snow guard tube above the roof. In addition, the inventor envisions that the snow guard can include a backstop that projects above the enclosed tube with the enclosed tube being mounted directly to the roof surface or via an elastomeric membrane or flashing. This type of snow guard has the advantages of both a pipe-style and bar-style snow guard.

The inventor discovered that he could mix strings of infrared LEDs with visible light emitting LEDs to create a snow guard that was both heated and could display words and patterns. The infrared LEDs can be arranged so they heat the tube by both waste heat conduction and by infrared radiation. The visible light emitting LEDs can be arranged so they shine light through the cutouts in the shape of symbols, patterns, or words and conduct their waste heat to heat the tube.

The snow guard assembly can have their heating element controlled by a controller such as an automation controller or other electronic or electro-mechanical control system. The heating elements can be wired in a single zone or in two or more zones within the snow guard tube. A system controller can separately drive the heating elements based on feedback control from snow sensors positioned in each zone or by other factors such as air temperature, weather forecast, or precipitation.

This Summary introduces a selection of concepts in simplified form described the Description. The Summary is not intended to identify essential features or limit the claimed subject matter.

DRAWINGS

DESCRIPTION

The terms "left," "right," "top, "bottom," "upper," "lower," "front," "back," and "side," are relative terms used throughout the to help the reader understand the figures. Unless otherwise indicated, these do not denote absolute direction or orientation and do not imply a preference. When describing the figures, the terms "top," "bottom," "front," "rear," and "side," are from the perspective of a snow guard mounted parallel to a front length-wise edge of a roof. Specific dimensions should help the reader understand the scale and advantage of the disclosed material. Dimensions given are typical and the claimed invention is not limited to the recited dimensions. The term "inventor," used throughout this disclosure, can mean one or more inventors.

The following terms are used throughout this disclosure and are defined here for clarity and convenience.

Infrared Light Source: As defined in this disclosure, an infrared light source is device that emit and directs light predominately within the infrared spectrum and is designed to primary generate infrared rather than visible light. Examples of infrared light sources include infrared LEDs, and infrared quartz emitters, and carbon infrared emitters, and nichrome wire coils coupled with an infrared reflective surface. Short wave infrared light sources emit infrared light primarily in the range of 780 nm to 1.4 μm. Medium wave infrared light sources emit infrared light primarily in the range of 1.4 μm to 3 μm. Far infrared light sources emit infrared light primarily above 3 μm.

Radiant Infrared Emitter: As defined in this disclosure, a radiant infrared emitter is device that emits and directs light predominately within the infrared spectrum is designed to primary generate infrared rather than visible light, and when used as a heat generation device, uses as its primary mode of heat generation radiative emission in the infrared spectral band rather than conduction or convention. Examples of radiant infrared emitter include infrared LEDs, and infrared quartz emitters, carbon infrared emitters, and nichrome wire coils coupled with an infrared reflective surface. Short wave infrared light sources emit infrared light primarily in the range of 780 nm to 1.4 μm. Medium wave infrared light sources emit infrared light primarily in the range of 1.4 μm to 3 μm. Far infrared light sources emit infrared light primarily above 3 μm.

The inventor noted that one problem with snow guards is that in unexpected large storms or long cold winters, snow may accumulate beyond the capacity of the snow guard and spill over the top of snow guard tubes. The inventor reasoned that he could heat the snow guard tubes to prevent excess accumulation of snow and to melt snow and ice gradually. To make the snow guard easy to assemble and service, the inventor discovered that he could construct the snow guard tube so that the top of the tube was length-wise separable.

Figure 38:
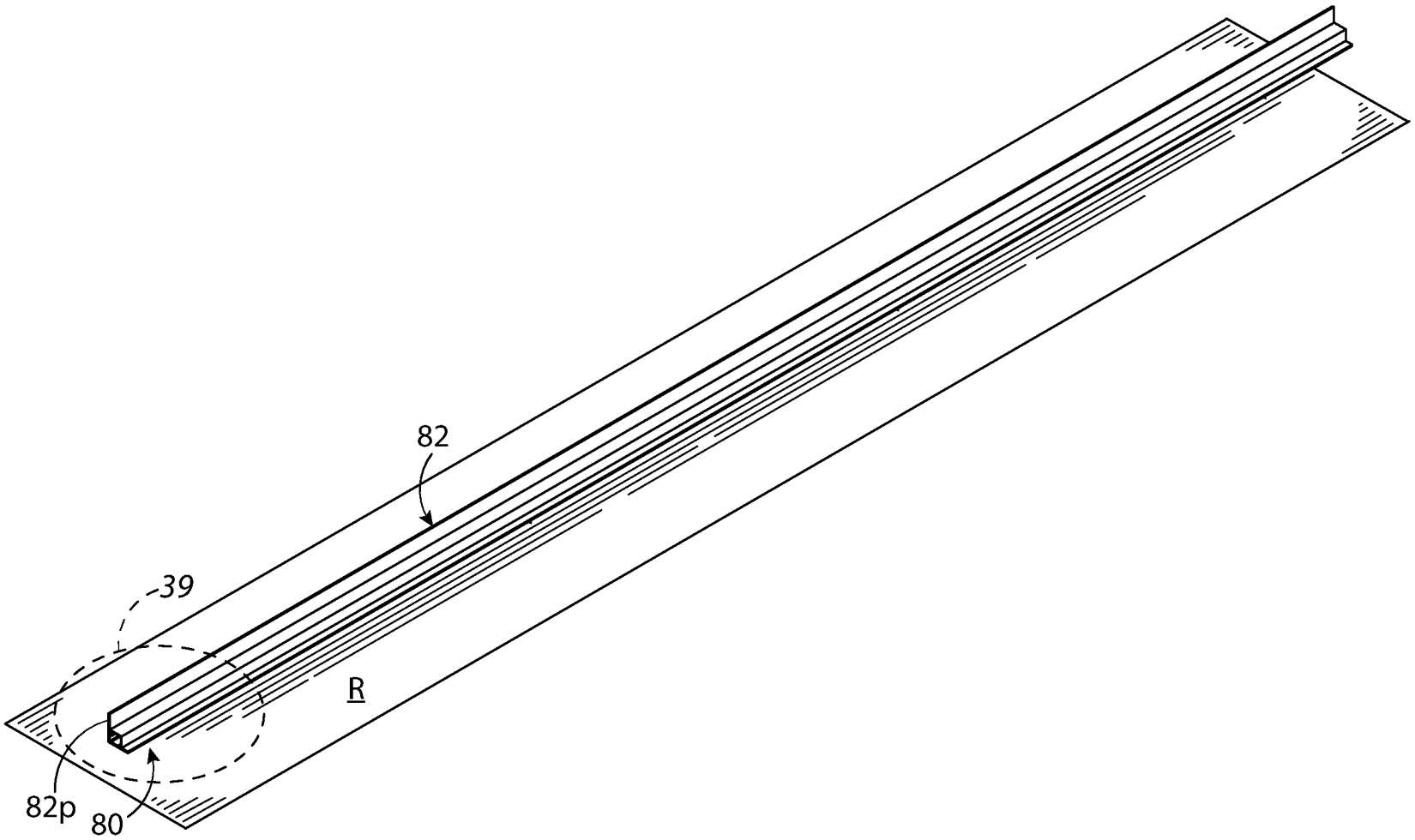
FIG. 38 illustrates the snow guard of FIG. 30, mounted to a concrete or flat metal roof.
Figure 39:
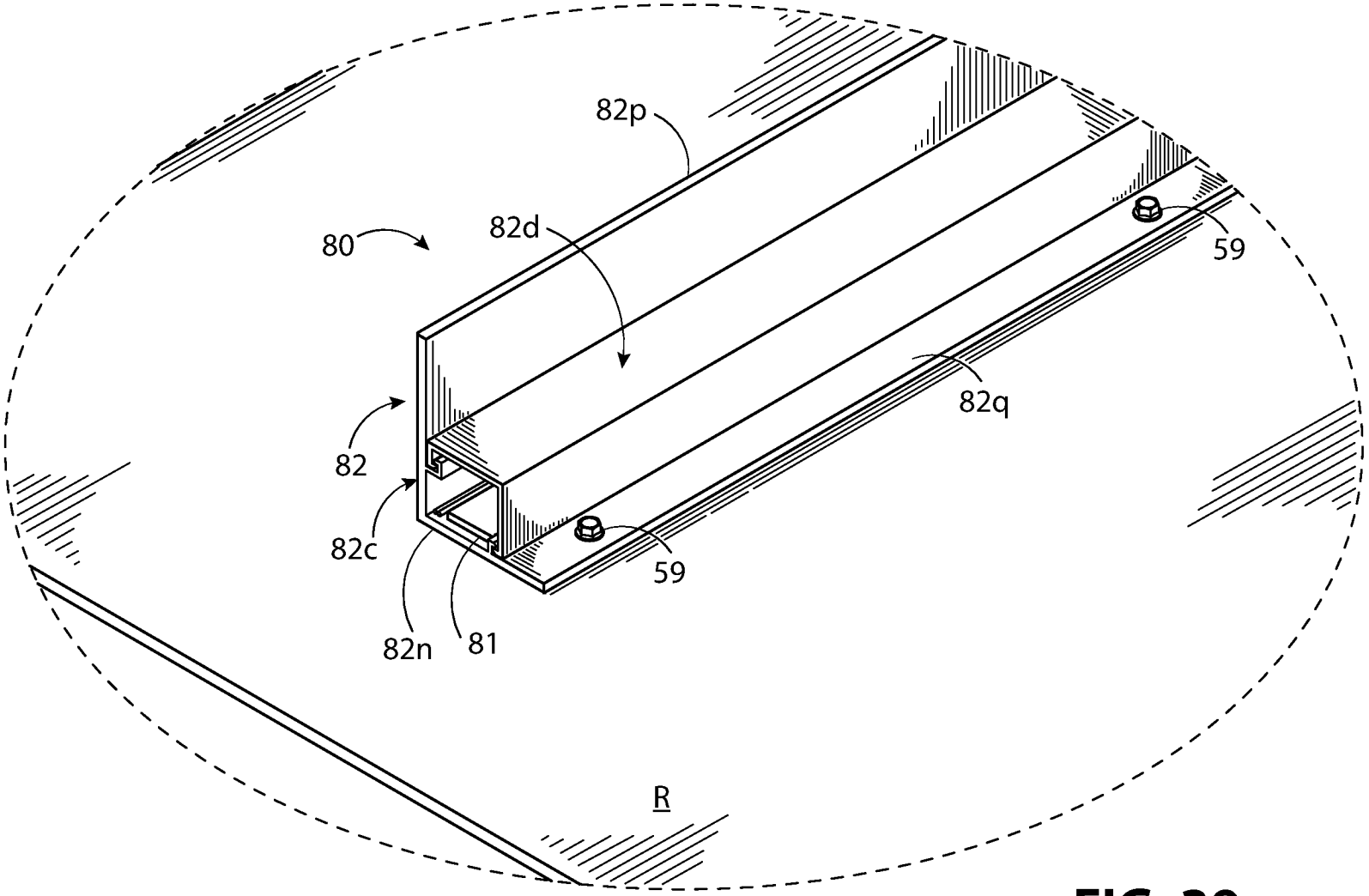
FIG. 39 illustrates a detail view of FIG. 38, indicated in FIG. 38 by the dashed portion called out with the numeral 39, and enlarged to show a second portion of the snow guard tube in greater detail.
Figure 40:
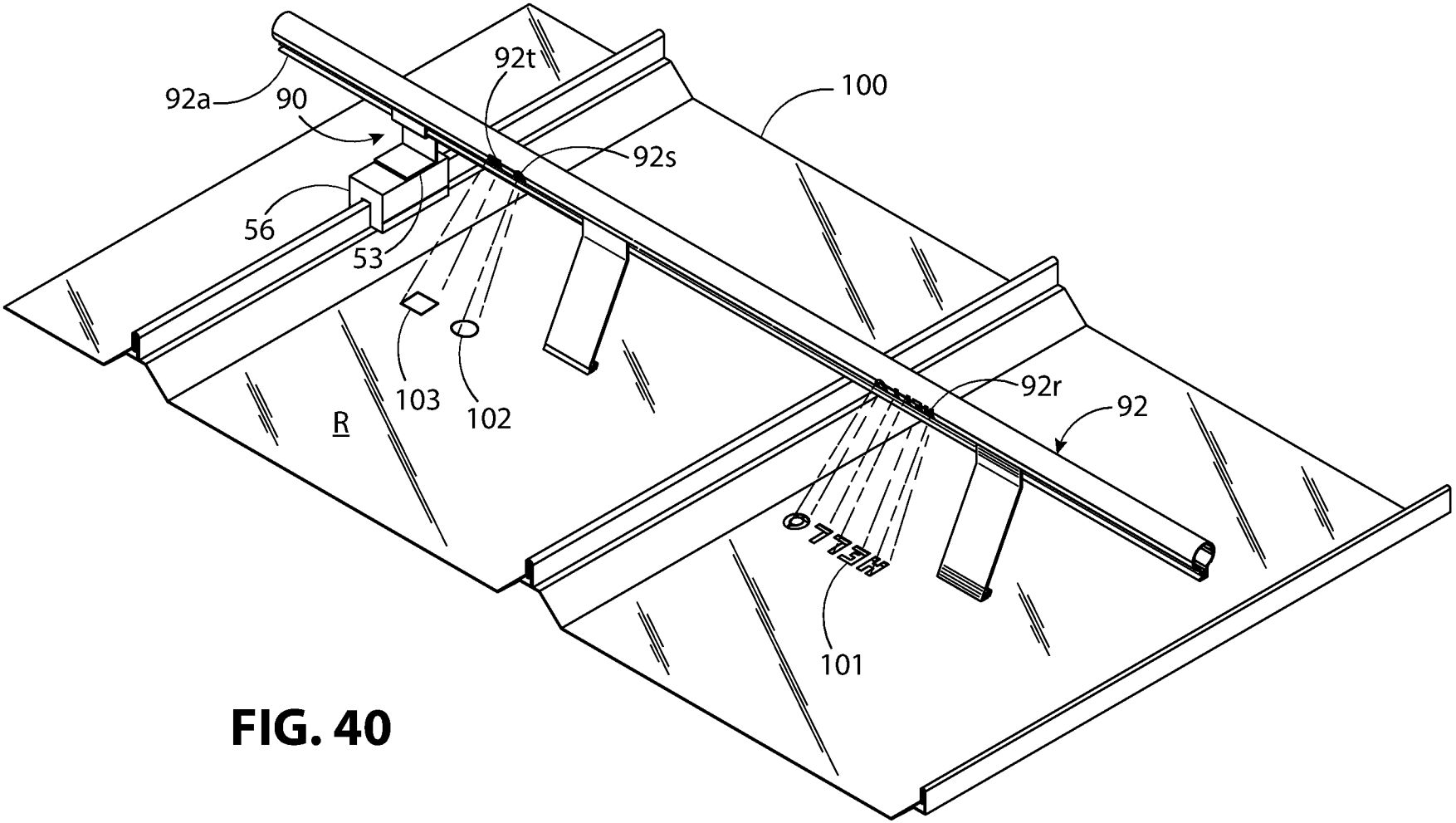
FIG. 40 illustrates a fifth example of a snow guard mounted to a portion of a roof in top perspective view where the snow guard uses visible light emitting LEDs to project patterns or words on the roof.
Figure 41:
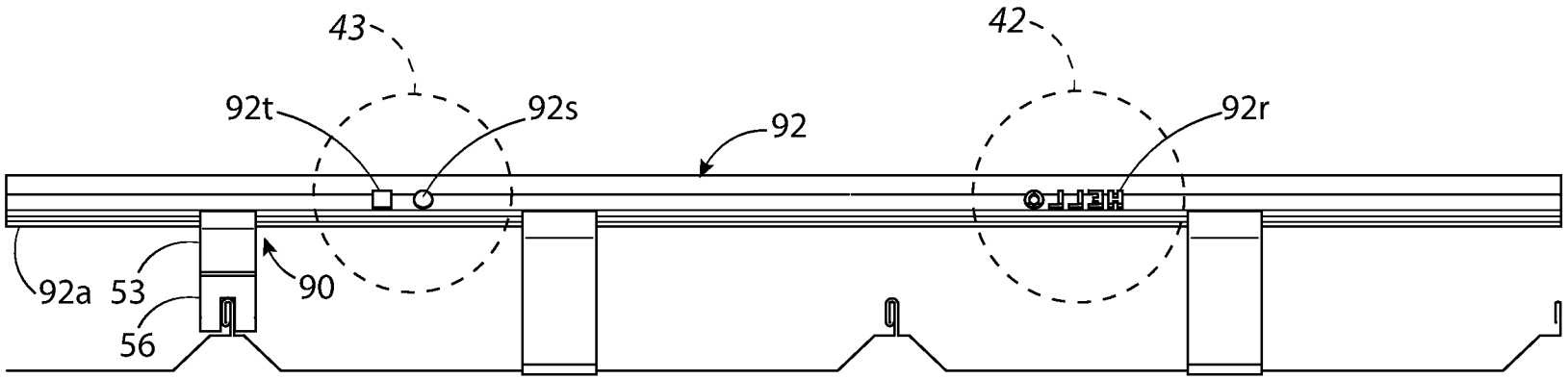
FIG. 41 illustrates the snow guard assembly of FIG. 40 in front elevation view.
Figure 42:
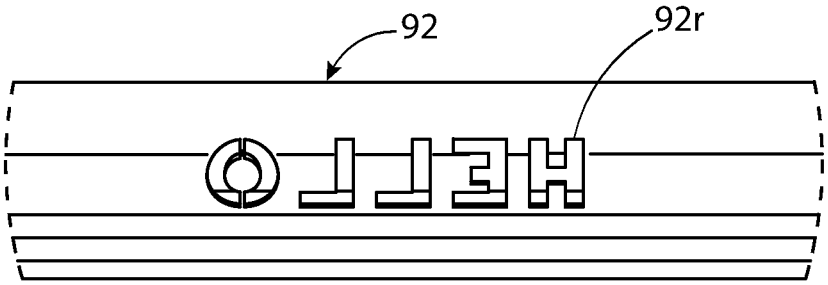
FIG. 42 illustrates a detail view of FIG. 41, indicated in FIG. 41 by the dashed portion called out with the numeral 42, and enlarged to show a first portion of the snow guard tube in greater detail.
Figure 43:
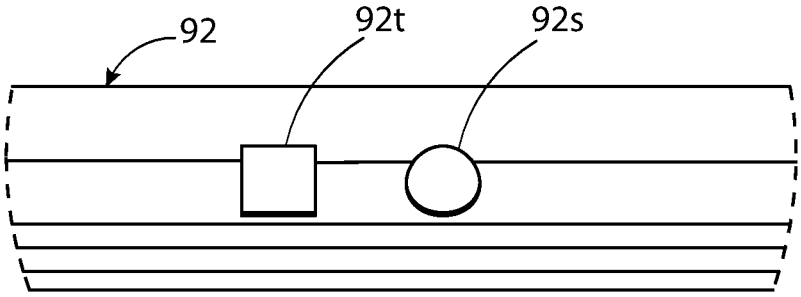
FIG. 43 illustrates a detail view of FIG. 41, indicated in FIG. 41 by the dashed portion called out with the numeral 43, and enlarged to show a second portion of the snow guard tube in greater detail.
Figure 44:
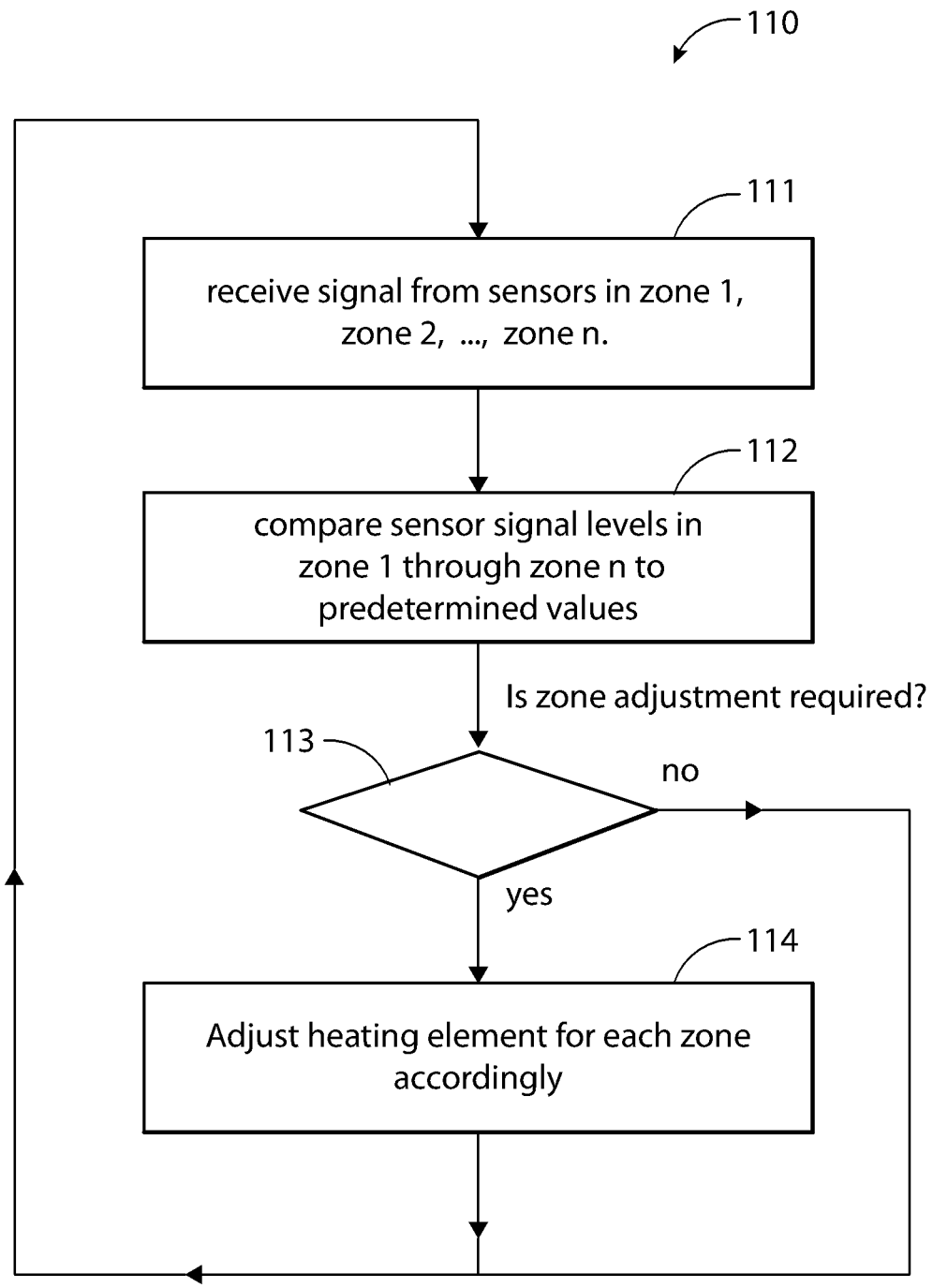
FIG. 44 illustrates a flow chart for adjusting the heating elements within the snow guard assemblies.
Figure 45:
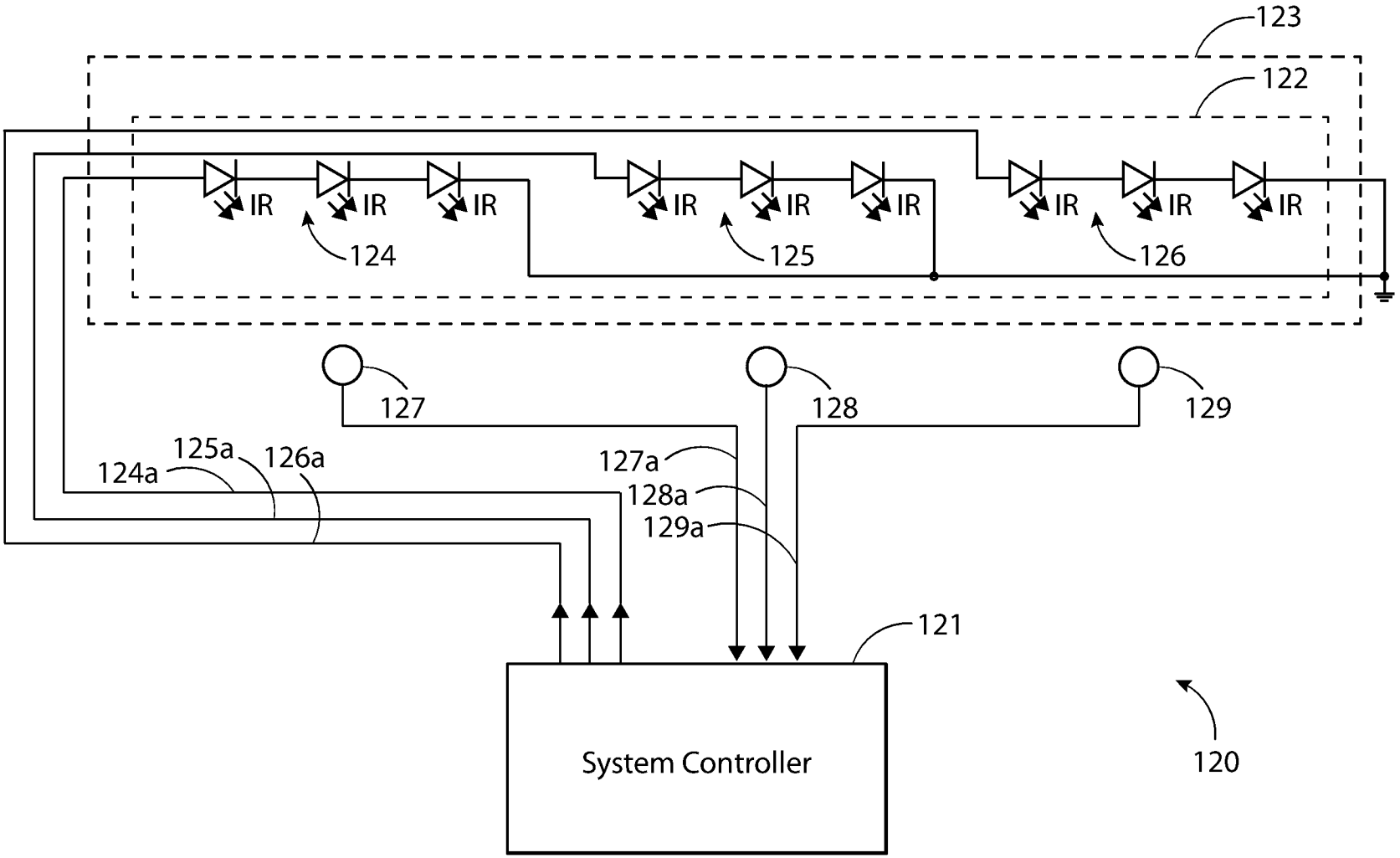
FIG. 45 illustrates a typical automation control system for adjusting the heating elements within the snow guard assemblies.

FIGS. 1-45 illustrates various aspects of a heated snow guard, conceived by the inventor, in six examples. In these figures, like numerals refer to like elements throughout the views. The first example of a snow guard assembly 50 illustrated in FIGS. 1-3 and 6 and discussed for FIGS. 1-10. The second example of a snow guard assembly 60 is illustrated in FIGS. 11-13, 16, and 19-21, and discussed for FIGS. 11-21. The third example of a snow guard assembly 70 is illustrated in FIGS. 22-25 and discussed for FIGS. 22-29. The fourth example of a snow guard assembly 80 is illustrated in FIGS. 30, 31, 33, 38, and 39, and discussed for FIGS. 30-39. The fifth example of a snow guard assembly 90 is illustrated in FIGS. 40 and 41 and discussed for FIGS. 40-43. FIGS. 44 and 45 show a flow chart 110 (FIG. 44) and a snow guard control system 120 that can be applied to all five of the snow guard assemblies 50, 60, 70, 80, 90.

In all these five examples, the snow guard assemblies 50, 60, 70, 80, 90 each project above the roof surface. In this way, they act like a barrier or fence for snow and ice. The heating elements prevent excess snow accumulation. The inventor discovered that he could direct the heat to optimize snow melt. The inventor found several ways, that could be used alone or in combination, to direct the heat. These include: using infrared LEDs, radiant infrared emitters, or other infrared light or heating sources, as well as directing the infrared light. In addition, the inventor found that he could vary the wall thickness of the snow guard tube to direct the heat, creating a multi-chamber snow guard tube with one or more heating elements or with a heating element isolated from a heat storage capacitor, or using an infrared absorbing or reflective coating in combination with an infrared heating source to direct the heat. These discoveries will be described in the disclosure that follows.

Figure 1:
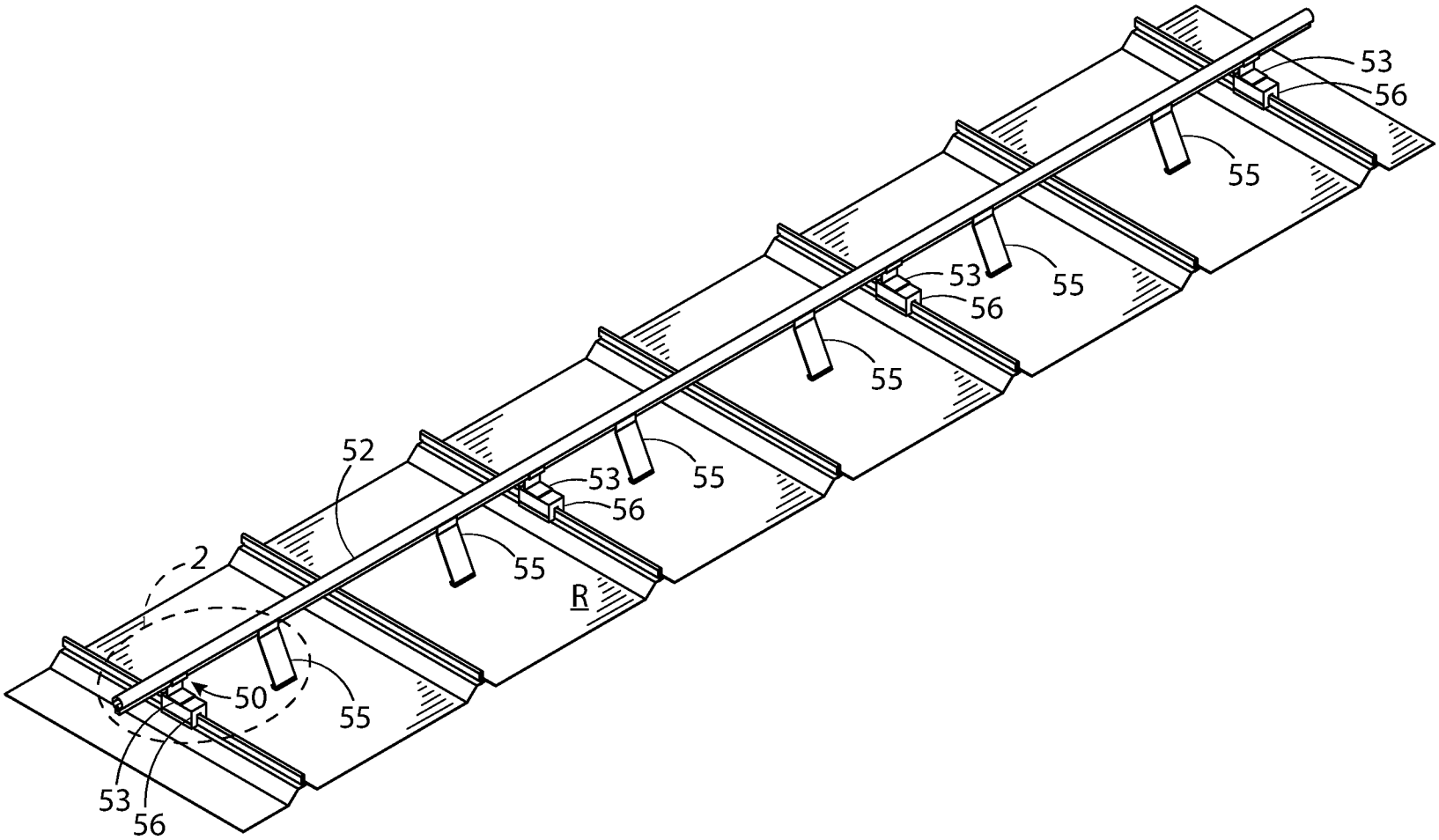
FIG. 1 illustrates a snow guard assembly mounted to a portion of a roof in top, front, and perspective view.
Figure 2:
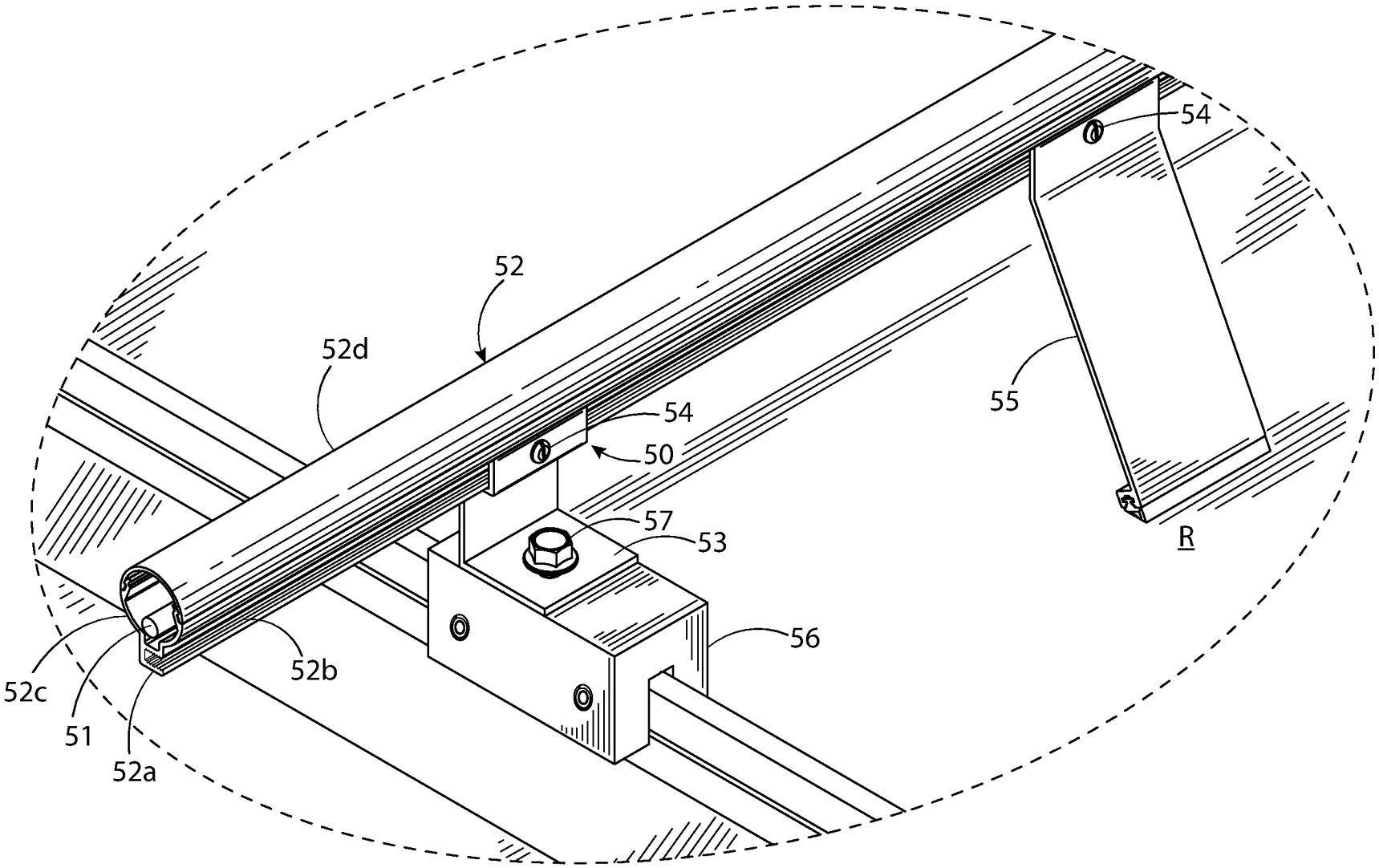
FIG. 2 illustrates a detail view of FIG. 1, indicated in FIG. 1 by the dashed portion called out with the numeral 2, and enlarged to show the end portion of the snow guard in greater detail.
Figure 3:
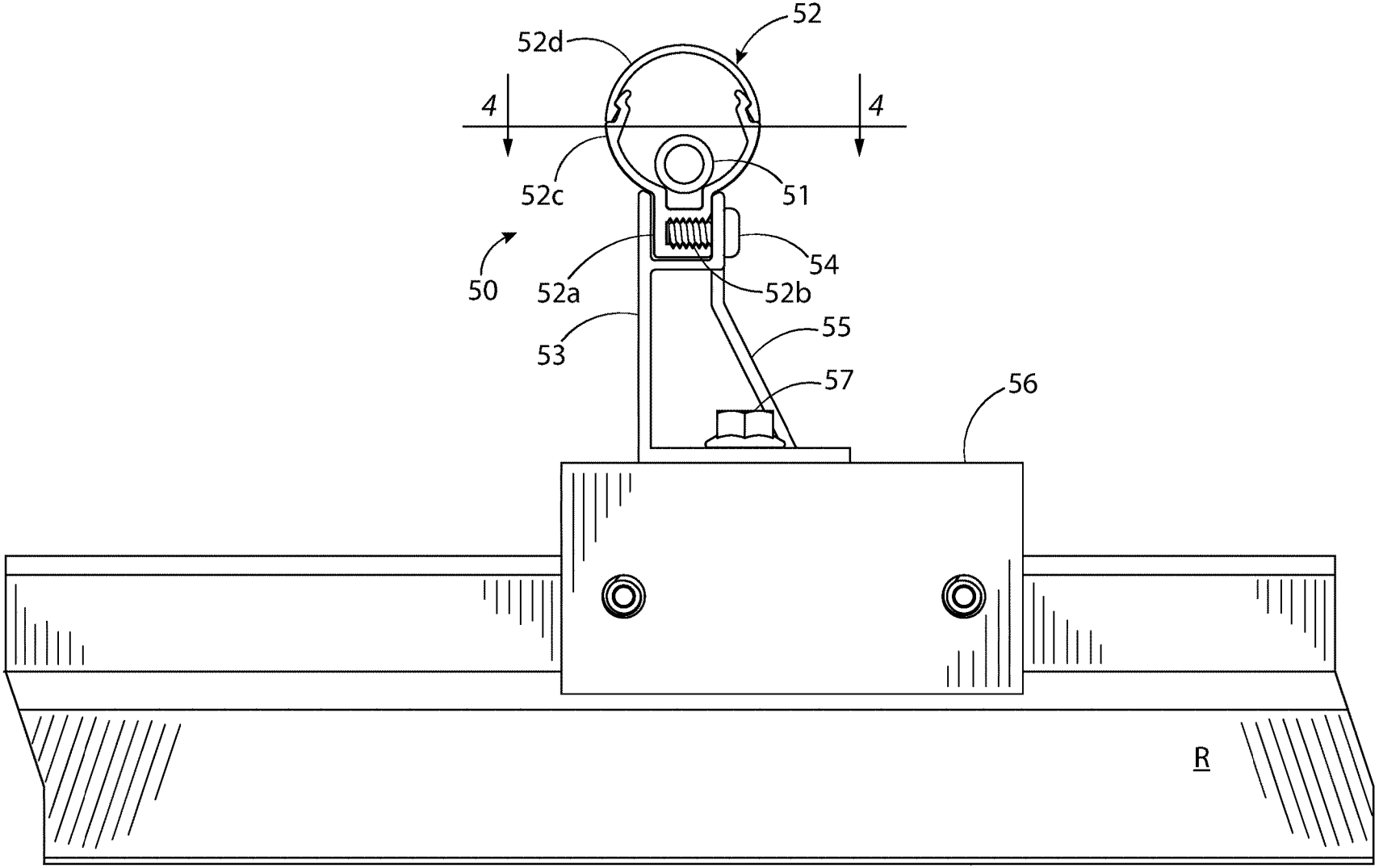
FIG. 3 illustrates a portion of FIG. 1, in side elevation view, showing an enlarged view of the snow guard.
Figure 8:
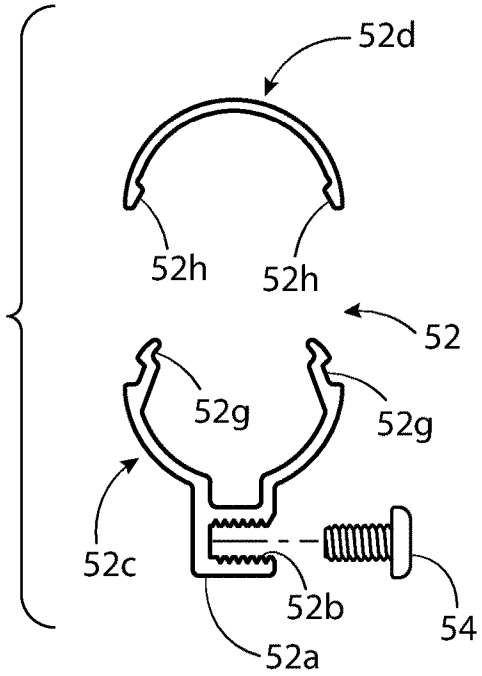
FIG. 8 illustrates the snow guard tube of FIG. 7 in exploded side elevation view.
Figure 9:
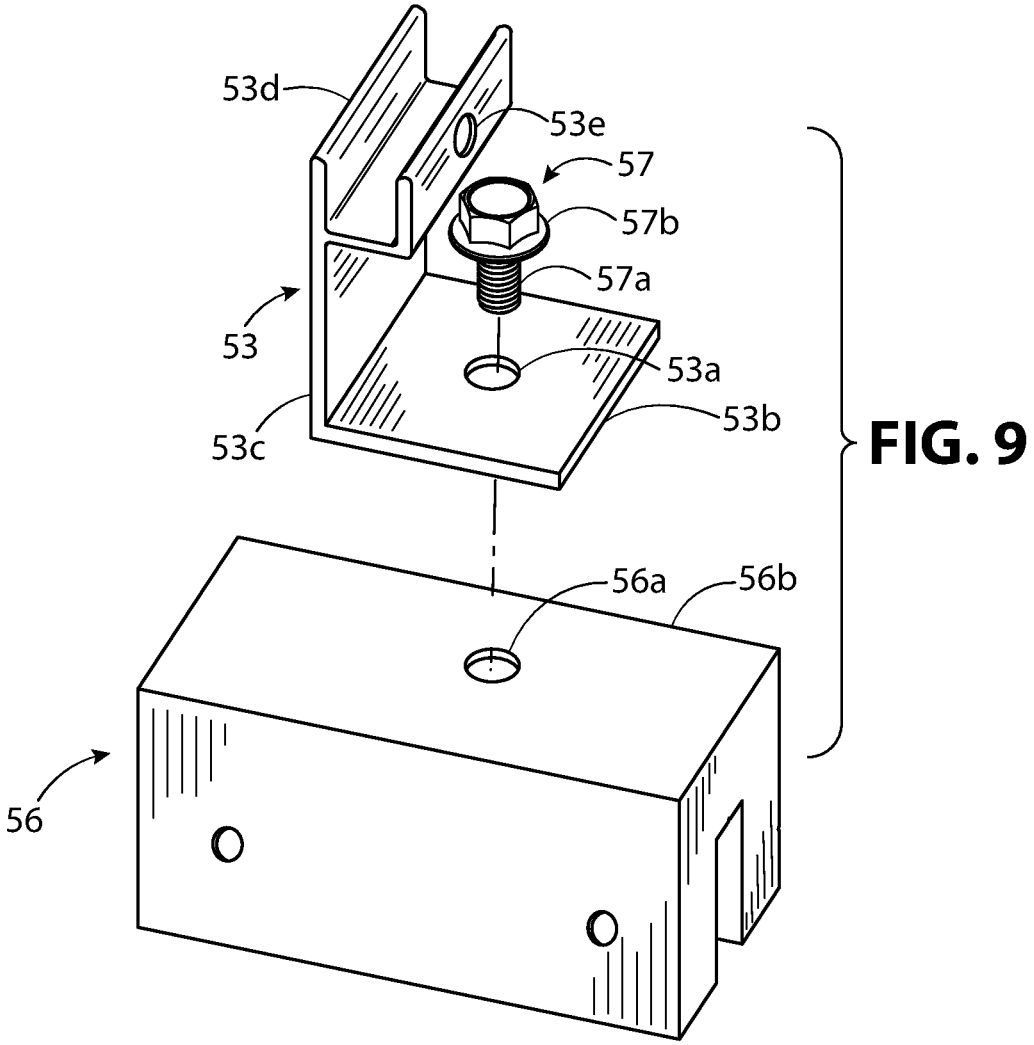
FIG. 9 illustrates the snow guard mounting bracket and seam clamp in front, top, and exploded perspective view.

Referring to FIGS. 1-3, the snow guard assembly 50 includes a heating element 51 (FIGS. 2 and 3), a snow guard tube 52, and optionally, a mounting bracket 53. The snow guard tube 52 can be attached to the mounting bracket 53 by riveting, welding, or by integrally extruding or otherwise forming the snow guard tube 52 and the mounting bracket 53. The snow guard tube 52 and the mounting bracket 53 are typically extruded, cast, machined, or otherwise formed from a heat conductive material such as aluminum or steel. The snow guard tube 52 typically has an enclosed cross section and an enclosed perimeter surface as illustrated and can have optional end caps (not shown) to create an enclosed air space. As illustrated in FIGS. 2 and 3, the snow guard tube 52 can be attached to the mounting bracket 53 by a threaded fastener 54. The threaded fastener 54 can be a screw, bolt, or any other threaded fastener capable of securing the snow guard tube 52 to the mounting bracket 53 and withstanding typical forces of snow pushing against the snow guard assembly 50. In FIGS. 2, 3, 7 and 8, the snow guard tube 52 can include a snow guard tube mounting portion 52*a* that receives the threaded fastener 54. The snow guard tube mounting portion 52*a* can include length-wise grooves 52*b* that are shaped and sized to threadedly engage the threaded fastener 54. Referring to FIG. 2, this structure allows the mounting bracket 53 to be mounted anywhere along the snow guard tube 52. Referring to FIGS. 2, 3, and 9, the snow guard tube mounting portion 52*a* (FIGS. 2 and 3) rests within the tube mounting portion 53*d* (FIG. 9) of the mounting bracket 53. The mounting portion extends upward from the mounting bracket stem 53*c* (FIG. 9). The mounting bracket stem 53*c* extends upward from the mounting bracket base 53*b* (FIG. 9). The threaded fastener 54 (FIGS. 2 and 3) engages the snow guard tube mounting portion 52*a* through an aperture 53*e* (FIG. 9) in the tube mounting portion 53*d*.

Figure 4:
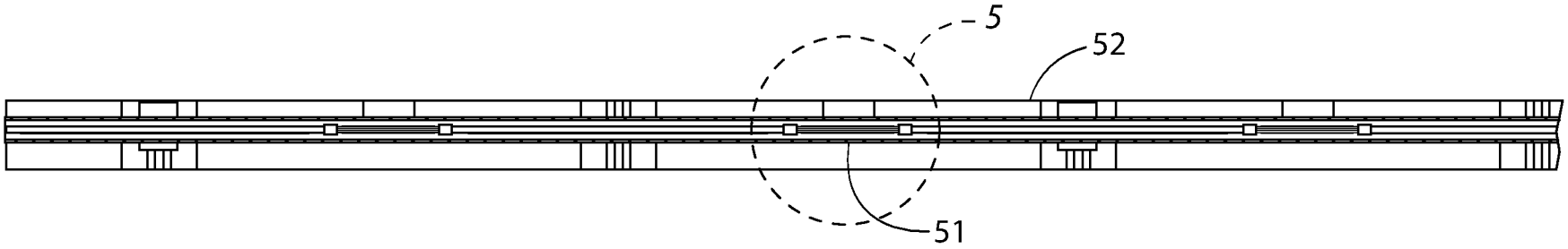
FIG. 4 illustrates a section view of FIG. 3 taken along section lines 4-4.
Figure 5:
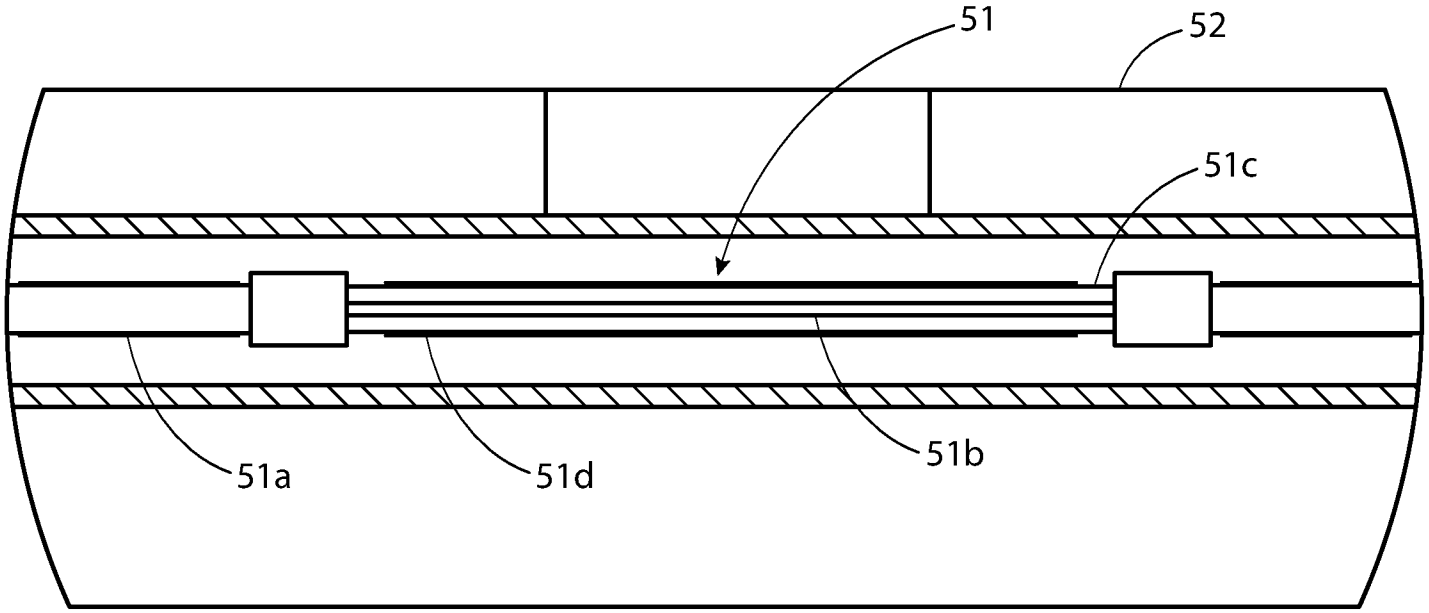
FIG. 5 illustrates a detail view of FIG. 4, indicated in FIG. 4 by the dashed portion called out with the numeral 5, and enlarged to show the heating element in more detail.
Figure 6:
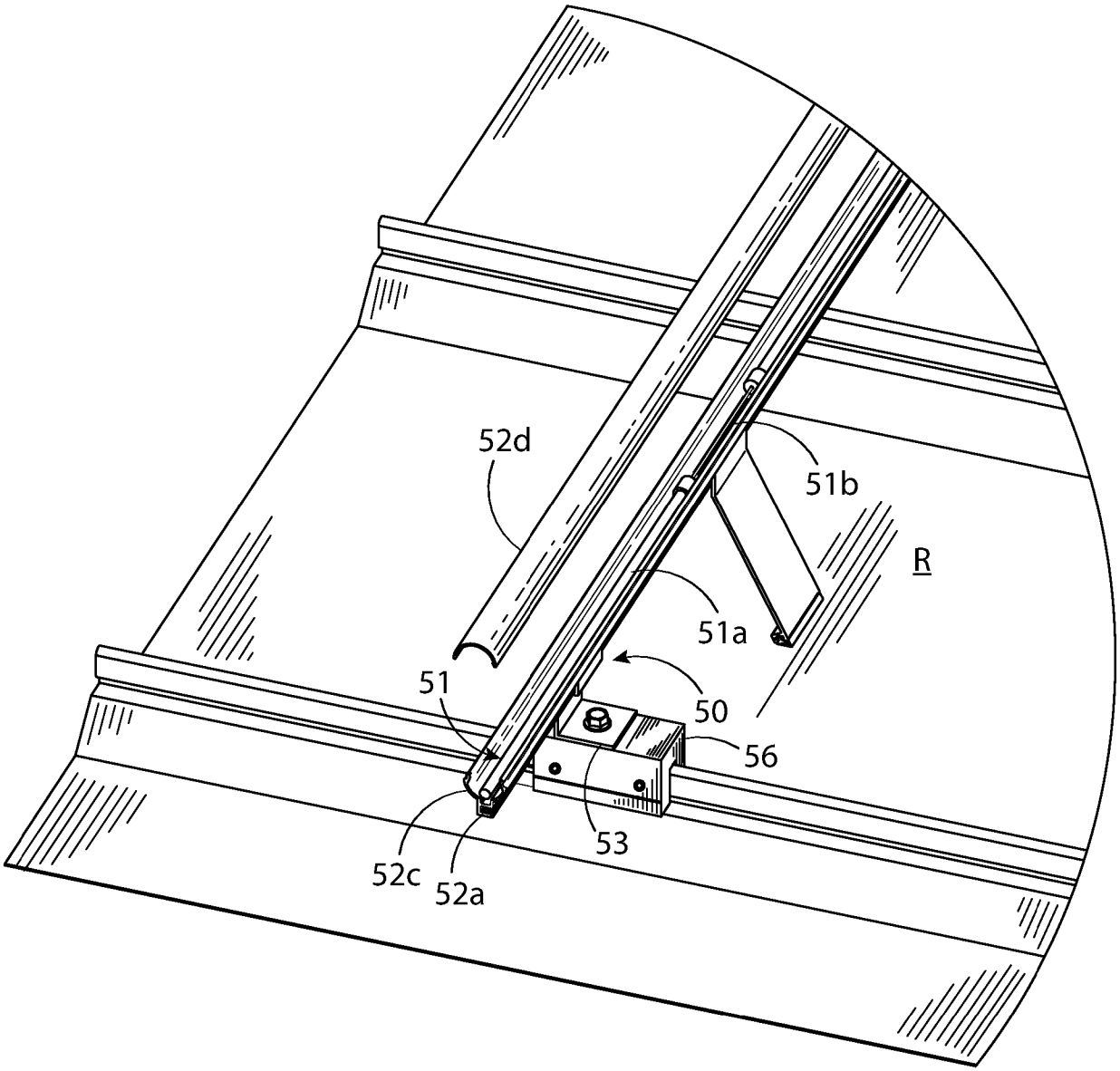
FIG. 6 illustrates a portion of the snow guard of FIG. 1, in top, side, and perspective view, with the snow guard tube in exploded view to show the heating element.

Referring to FIGS. 2-6, the heating element 51 can be a series of infrared LEDs as illustrated. FIG. 4, which illustrates a section view of FIG. 3 taken along section lines 4-4, shows the heating element 51 extending length-wise along the snow guard tube 52. FIG. 5 illustrates a detail view of FIG. 4, showing an enlarged section of the snow guard tube 52 and the heating element 51 in more detail. In FIGS. 5 and 6, the heating element 51 can include a wire 51*a* that is electrically conductive and can be weather insulated against water and snow. Wire 51*a* conducts electrical current to an infrared LED tube 51*b*. The infrared LEDs can include a weather resistant cover 51*c* (FIG. 5) and a reflective light shield 51*d* (FIG. 5) that directs the infrared light. This is one advantage of using infrared LEDs as a heating element over heat tape, heat trace cable, or other heated wires. LEDs produce waste heat at their diode junction. The waste heat typically dissipates through the base surface of the LED. Referring to FIGS. 3 and 6, this waste heat can be thermally conducted through in a specific direction or through a specific portion of the snow guard assembly 50. For example, the waste heat can be conducted through a snow guard tube mounting portion 52*a* and into the mounting bracket 53.

Figure 7:
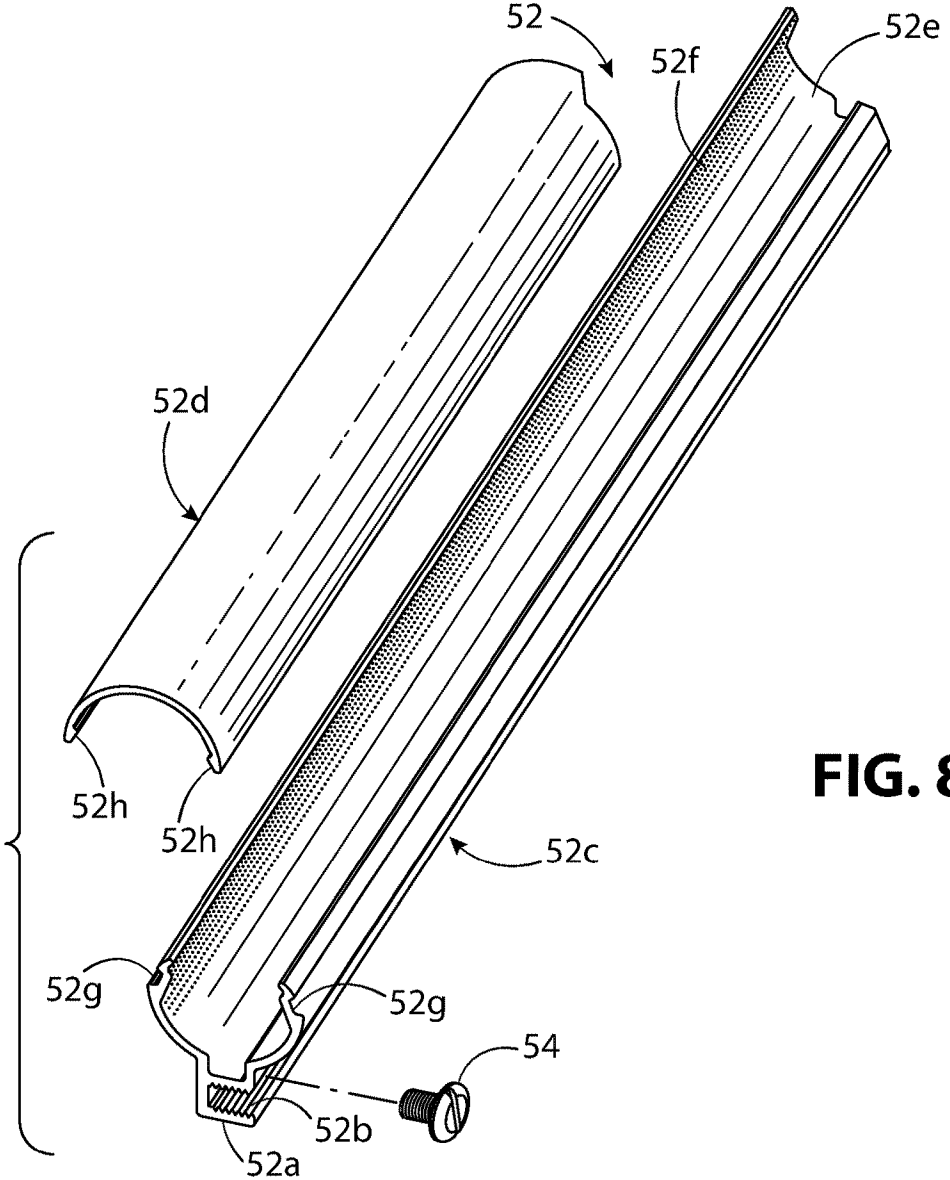
FIG. 7 illustrates a portion of the snow guard tube in top and exploded perspective view.

The inventor discovered that dividing the snow guard tube 52 into separable portions always for easier assembly and servicing of the heating element 51. Referring to FIGS. 2, 3, and 6-8, the snow guard tube 52 is divided into a first tube portion 52*c* and a second tube portion 52*d* each extending length-wise along the tube. The first tube portion 52*c* and the second tube portion 52*d* can snap together. In FIGS. 7 and 8, first length-wise edges 52*g* of the first tube portion 52*c* and second length-wise edges 52*h* of the second tube portion 52*d* are shaped so they snap together hold securely to each other. In these figures, the first length-wise edges 52*g* are shaped to spring outward and place outward pressure on the second length-wise edges 52*h*. The second length-wise edges 52*h* can be barbed, as illustrated, to catch and secure the first length-wise edges 52*g* as the first length-wise edges 52*g* spring outward. The inventor envisions that a wide range of structures can join the first tube portion 52*c* and a second tube portion 52*d*. For example, the first tube portion 52*c* and a second tube portion 52*d* can be hinged along one of the first length-wise edges 52*g* and one of the second length-wise edges 52*h* and snap together along the opposite edges as described above. As another example, the first tube portion 52*c* and a second tube portion 52*d* can be secured together by adjustable pipe clamps.

To the inventor's knowledge, he is the first to use infrared LEDs as a heating element in a snow guard. Infrared LEDs, radiant infrared emitters, and infrared light sources are typically used where the infrared light can radiate outward into an open space. For example, infrared quartz heating elements are typically used in reflective room heaters. A reflective back surface, typically parabolic, projects the infrared light into either an interior or exterior space to heat a specific area. Arrays of infrared LEDs mounted against back reflective surfaces are similarly used to heat specific indoor or outdoor spaces. In addition, infrared LED in waterproof fixtures, combined with large blower fans, are used in automated car washes to dry water vehicles. In all these examples, the infrared LEDs are used to project infrared energy out into an exterior environment. The inventor discovered that he could advantageously apply infrared LEDs to an enclosed space where the surface enclosing the space, in this case the snow guard tube 52 in FIGS. 1-8, can be substantially opaque to infrared energy and/or visible light.

The snow guard tube 52 interior can be infrared reflective or absorptive, depending the material the tube is made from. The snow guard tube 52 can be selectively coated with an infrared reflective or absorptive surface coating to redirect the heat to a specific portion of the snow guard tube 52. For example, in FIG. 7, the interior surface 52*e* of a first tube portion 52*c* of the snow guard tube 52 can include a coating 52*f*, selectively applied to a portion of the interior surface 52*e* or applied to the entirety of the interior surface 52*e*, that either reflects or absorbs infrared. In FIG. 7, the coating 52*f* is shown selectively applied to a portion of the interior surface 52*e*. The coating 52*f* can be, for example, a standard flat black paint will absorb near-infrared radiation, or a paint or surface treatment specifically designed to reflect or absorb infrared radiation.

Because the roof R in FIGS. 1-3 and 6 is illustrated as a standing seam roof, the mounting bracket 53 can be fastened to a standing seam clamp 56. The mounting bracket 53 can be attached to the standing seam clamp 56 by a threaded fastener, welding, riveting, and other fasteners that have sufficient strength to hold the mounting bracket 53 to the standing seam clamp 56 while encountering the forces of wind, snow, rain, and ice. Referring to FIGS. 2, 3, and 9, the mounting bracket 53 is shown attached to standing seam clamp 56 by a threaded fastener 57. As illustrated in FIG. 40, a transparent or translucent roof, such as roof with a glass, acrylic, or polycarbonate roof panels can easily be substituted for the metal standing seam roof in FIGS. 1-3 and 6.

Referring to FIG. 9, the threaded fastener body 57*a* passes through an aperture 53*a* in the mounting bracket base 53*b* and threadedly engages an aperture 56*a* in the standing seam clamp top surface 56*b*. The threaded fastener shoulder 57*b* rests against the mounting bracket base 53*b*. The aperture 56*a* is typically directly threaded, but also could include a press fit threaded insert. The standing seam clamp 56 can be any standing seam clamp 56 suitable for mounting the snow guard assembly 50 (FIGS. 1-3 and 6) to a standing seam roof. For example, the standing seam clamp 56, can be a standing seam clamp sold under the registered trademark ACE CLAMP® by PMC Industries, Inc.; a standing seam clamp sold model number ASGU2 sold by Alpine Snow Guards; a standing seam clamp sold under the registered trademark S5!® by METAL ROOF INNOVATIONS, LTD; or the inventor's own standing seam clamp, which is the subject of U.S. Pat. Nos. 8,910,928 and 8,528,888 and sold by Solar Innovations Inc. The choice of standing seam clamp is not critical. Referring to FIGS. 1-3 and 6, these examples illustrate how the snow guard assembly 50 can be attached to a standing seam roof. The snow guard assembly 50 can readily be attached to over roof types, for example, tile or shingle roofs as will be seen in the discussion for FIGS. 19-21.

Referring to FIGS. 1-3, The snow guard assembly 50 can optionally attach to a snow guard clip 55. The snow guard clip 55 prevents movement of ice and snow beneath the snow guard tube 52. Referring to FIGS. 2 and 3, the snow guard clip 55 can be attached to the snow guard tube 52 by a threaded fastener 54, such as a screw or bolt in a similar manner of attachment as the mounting bracket 53 to the snow guard tube 52. The threaded fastener 54 can be any threaded fastener capable of withstanding the forces of snow pressing against the snow guard tube 52.

Figure 10:
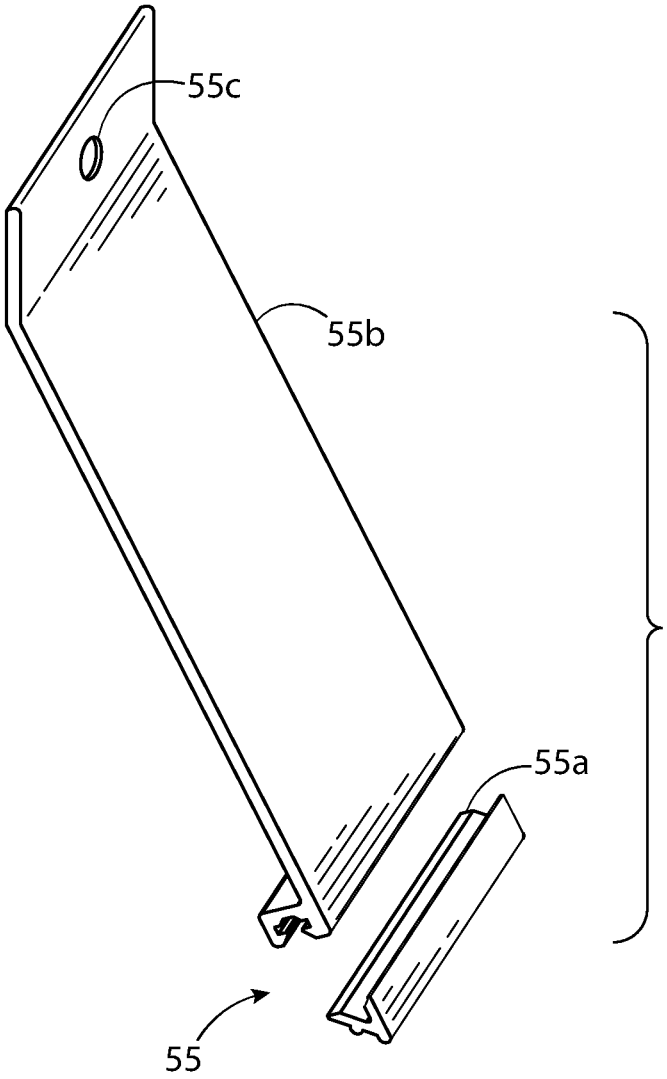
FIG. 10 illustrates a snow clip of FIG. 1 in exploded perspective view.

The snow guard clip 55 is shown in more detail in FIG. 10. Referring to FIG. 10, the snow guard clip 55 can include a clip mounting base 55*a* and a clip body 55*b*. The clip mounting base 55*a* can optionally be made from a flexible material such as rubber or an elastomer to hold to the roof by friction or tension. An aperture 55*c* receives and passes through the threaded fastener body 54*a* where it threadedly engages.

Figure 16:
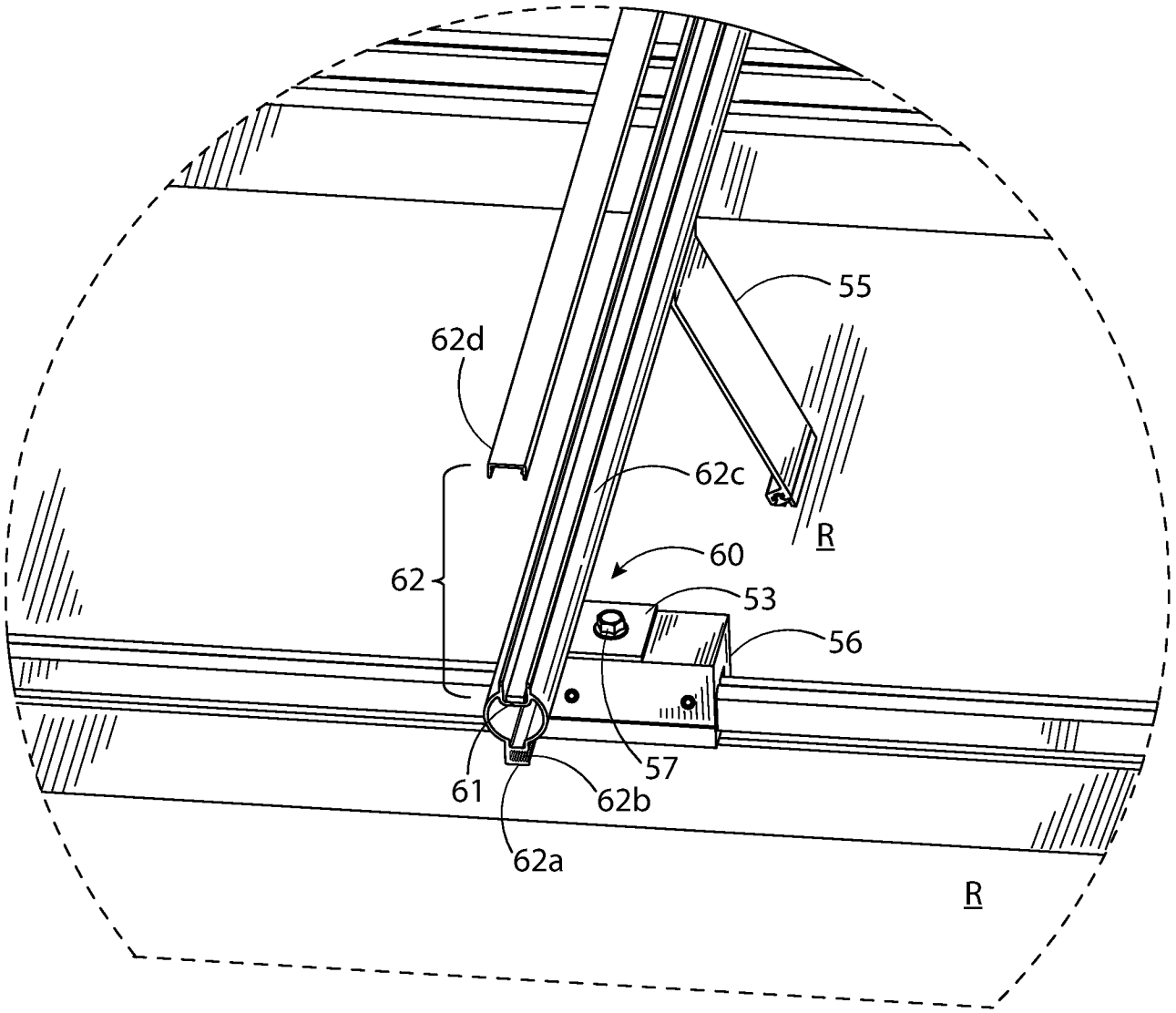
FIG. 16 illustrates a portion of the snow guard of FIG. 11, in top, side, and perspective view, with the snow guard tube in exploded view to show the heating element.
Figure 18:
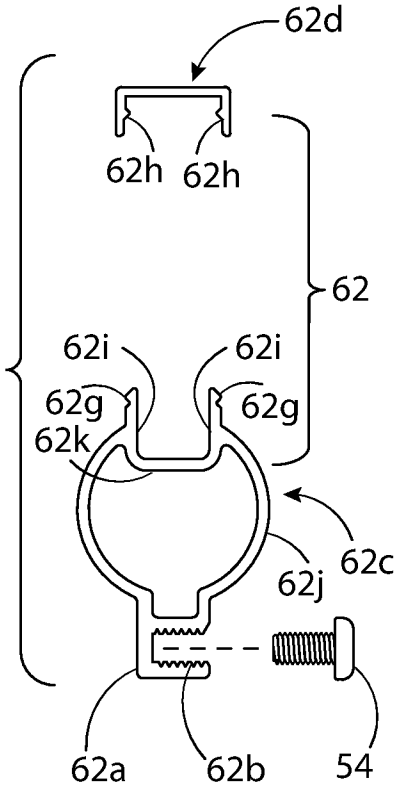
FIG. 18 illustrates the snow guard tube and heating element of FIG. 17 in exploded side elevation view.
Figure 17:
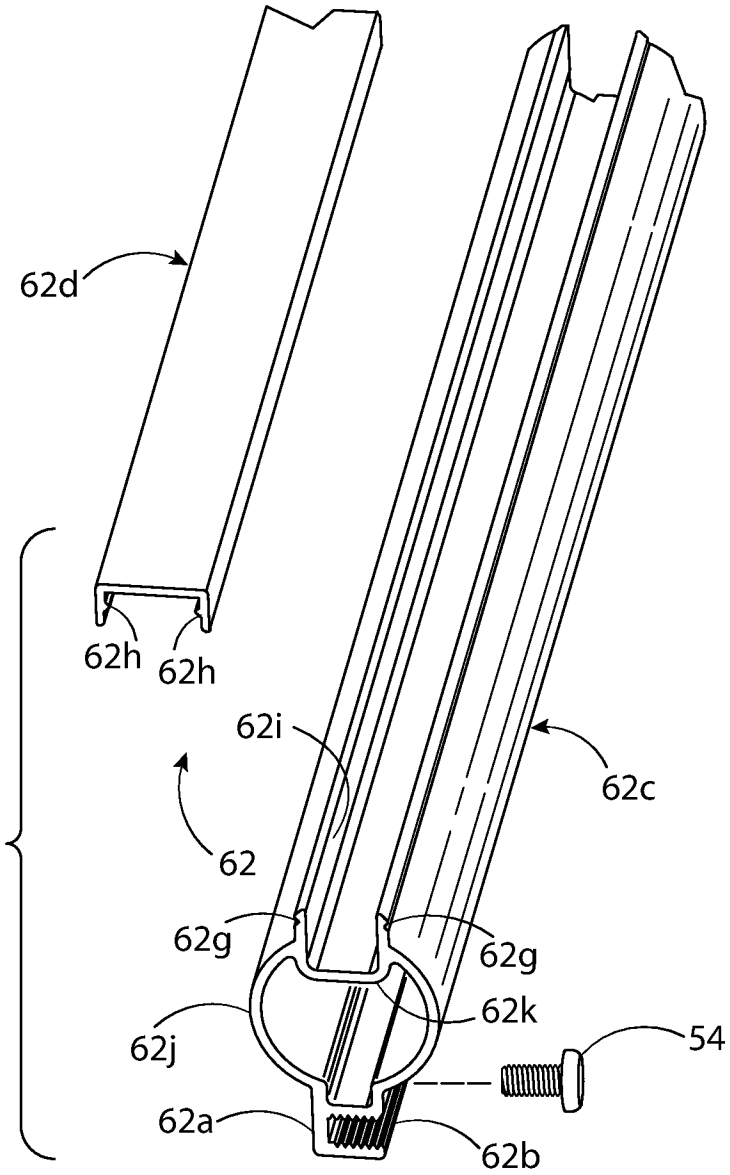
FIG. 17 illustrates a portion of the snow guard tube and heating element of FIG. 11, in top, side, and exploded perspective view.

FIGS. 11-21 illustrate various aspects of a snow guard assembly 60 (FIGS. 11-13, 16, 19-21) where the snow guard tube 62 is configured to mount the heating element 61 (FIGS. 12-16, 20, and 21), near the top of the snow guard tube 62. Referring to FIGS. 12, 13, 16-18, 20, and 21, the snow guard tube 62 is length-wise separable into a first tube portion 62*c* and a second tube portion 62*d*. Referring to FIGS. 17 and 18, the first tube portion 62*c* and the second tube portion 62*d* include first length-wise edges 62*g* and second length-wise edges 62*h*, respectively, that snap together and secure the first tube portion 62*c* and the second tube portion 62*d*. The first length-wise edges 62*g* are positioned at the ends of the upper section 62*i* of the first tube portion 62*c*. The second length-wise edges 62*h* are positioned at the ends of the second tube portion 62*d*. The first length-wise edges 62*g* and the second length-wise edges 62*h* can include a complementary tongue and groove with one of the edge pairs, in this case, the first length-wise edge 62*g* including a barbed end to hold the first tube portion 62*c* and the second tube portion 62*d* together.

Figure 13:
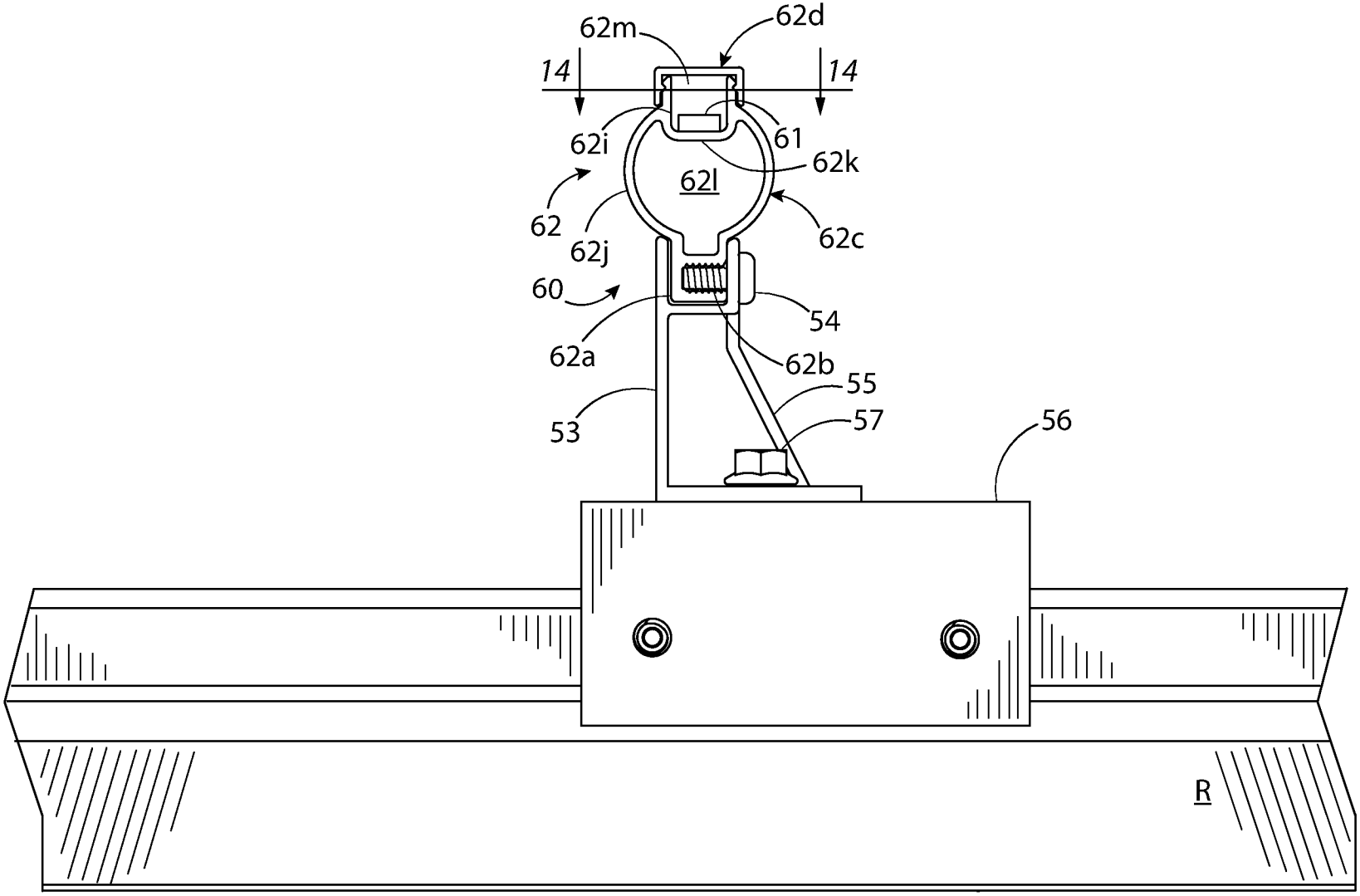
FIG. 13 illustrates a portion of FIG. 11, in side elevation view, showing an enlarged view of the snow guard.
Figure 14:
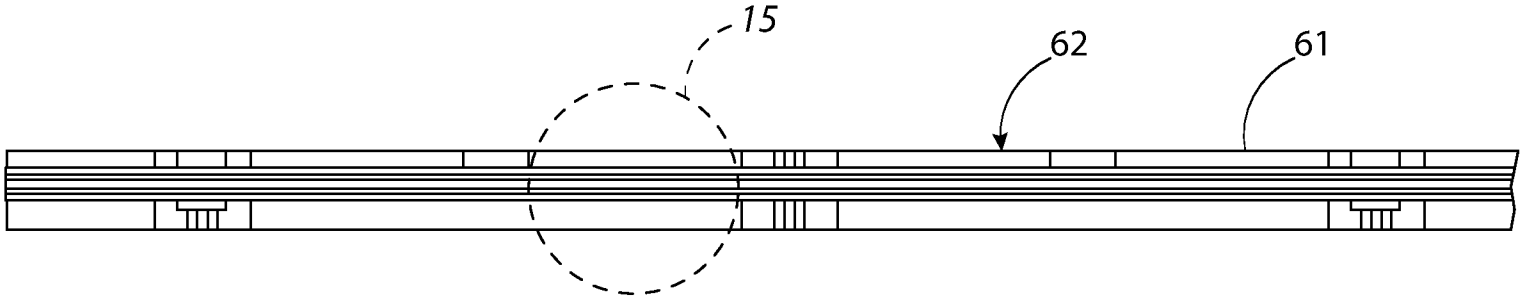
FIG. 14 illustrates a section view of FIG. 13 taken along section lines 14-14.
Figure 15:
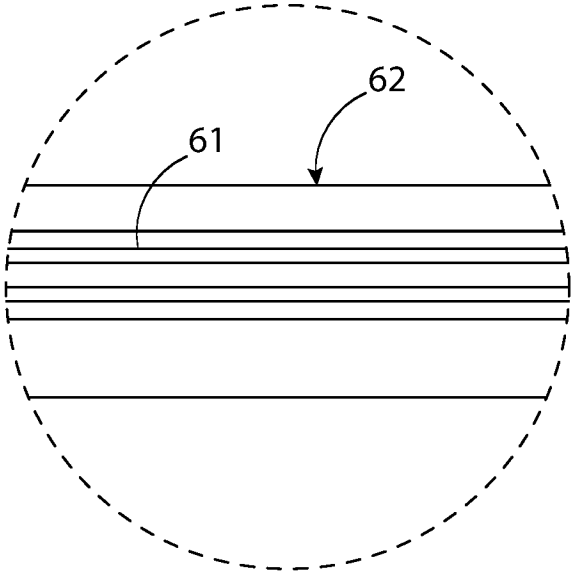
FIG. 15 illustrates a detail view of FIG. 14, indicated in FIG. 14 by the dashed portion called out with the numeral 15, enlarged to show the heating element in more detail.

Referring to FIGS. 13, 17, and 18, the first tube portion 62*c* and the second tube portion 62*d* are structured so the heating element 61 seats within an upper section 62*i* of the first tube portion 62*c*. The first tube portion 62*c* also includes a lower portion 62*j*. The lower portion 62*j* can include a fully enclosed cross-sectional outer perimeter with the top of the fully enclosed cross-sectional outer perimeter forming the mounting base 62*k* of the upper section 62*i*. The snow guard tube 62 typically has an enclosed cross section and an enclosed perimeter surface, as illustrated. Referring to FIG. 13, when optionally covered with end caps, the lower portion 62*j* forms a first chamber 62*l* that is fully enclosed and can act as an enclosed air space.

Referring to FIGS. 13, 17 and 18, the second tube portion 62*d* includes a c-shaped cross section sized and shaped to engage the upper section 62*i* of the first tube portion 62*c*. Referring to FIG. 13, the upper section 62*i* of the first tube portion 62*c* and the interior of the second tube portion 62*d* are size and shaped so that when secured together, they form a second chamber 62*m*. With optional end caps, the second chamber 62*m* can be fully enclosed.

The heating element 61 of FIGS. 12-16, 20, and 21 is illustrated as heating tape also known in the trade as heat tracing or heat trace. Heating wire can readily be substituted. Referring to FIG. 13, the heating element 61 is illustrated in thermal contact with the mounting base 62*k* of the upper section 62*i* of the first tube portion 62*c* of the snow guard tube 62. Because heating tape generally conducts heat on its top and bottom surface, thermal contact can be facilitated by creating physical contact between the heating element and the mounting base, for example, by clamping or adhesive. Thermal contact can be enhanced by using thermal paste, thermally conductive adhesive transfer tape, or a thermally conductive adhesive, between the bottom surface of the heating element 61 and the mounting base 62*k*. Heat transfer can also be enhanced by insulating the electrical conductors within the heating tape with a heat conductive electrical insulation such as magnesium oxide or magnesium oxide tape. Magnesium oxide is a well know heat conducting electrical insulator and commonly used in electrical heating elements. Heat transfer can also be enhanced by using heat tape sheathed with a metallic layer such as copper, aluminum, or stainless steel. For example, a metal sheathed heating cable sold by Drexan Energy Systems, Inc. under the registered trademark PIPEGUARD®. The heating element 61 can transmit heat through the mounting base 62*k* by conduction into the first chamber 62*l*. The air in the first chamber can act as a thermal capacitor and store some of the heat. One advantage to this two-chamber structure of the snow guard tube 62 is that the thermal capacitor is isolated from the heating element 61. For example, to further facilitate heat storage, the first chamber can be filed a heat storage material such as liquid optimized for thermal storage, or a solid-to-solid or a solid-to-liquid phase change material. The heating element 61, being in the second chamber 62*m* is isolated from the thermal storage material.

The snow guard tube 62 of FIGS. 11-21 can also include two sets of heating elements 61. Referring to FIG. 13, the heating element 61, in the form of heating tape, can be placed in the second chamber, as illustrated. In addition, a heating element 61 can be placed, as illustrated in FIG. 3. This heating element 61 can be, for example an LED strip. The LED strip can be positioned to heat one portion or two or more portions, i.e., one zone or two or more zones of the snow guard tube 62. For example, the LED strips could direct heat toward the snow mound facing side of the snow guard tube 62. Thermal sensors can be placed in these two or more zones to optimize heating.

Figure 11:
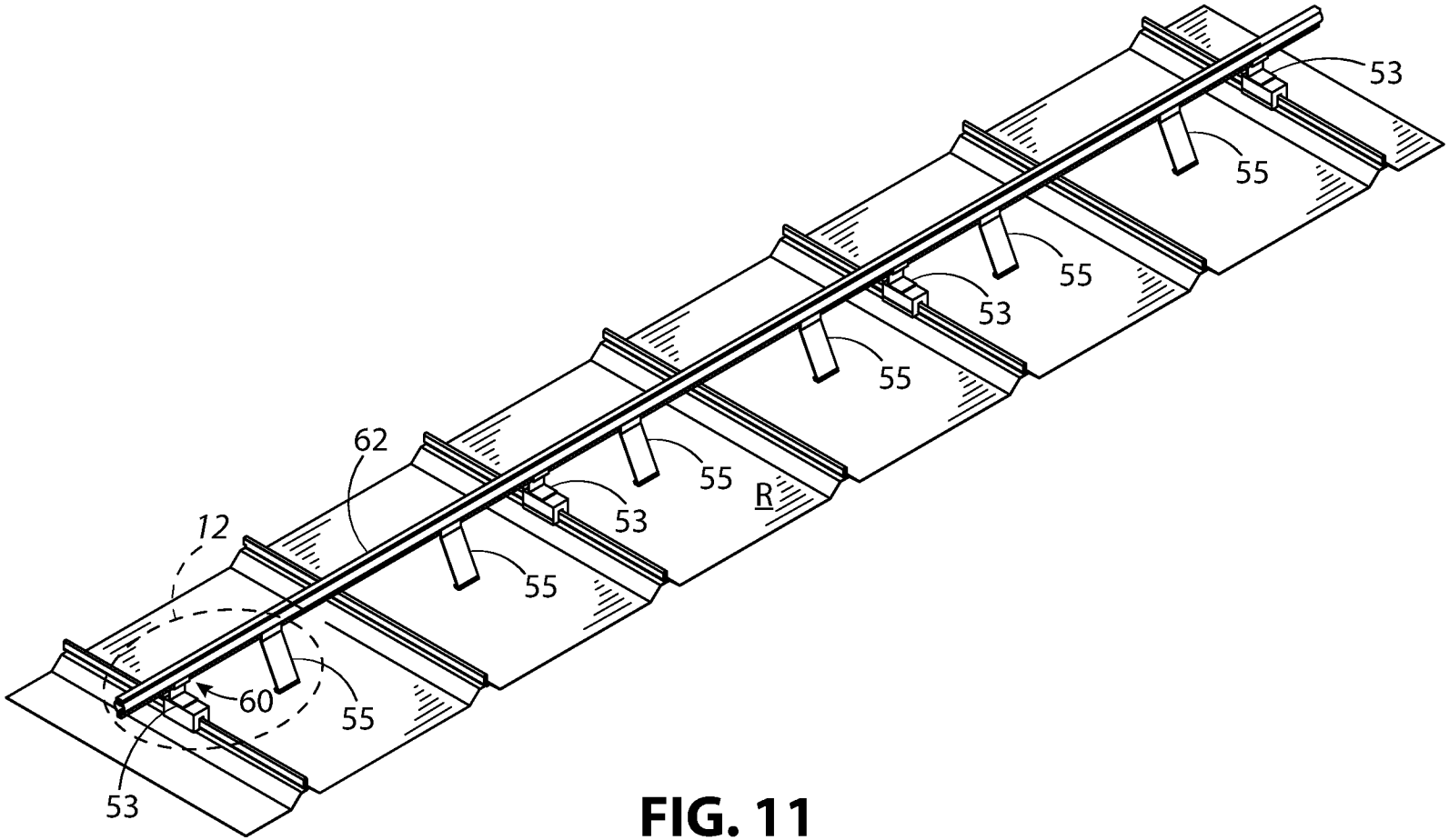
FIG. 11 illustrates a second example of a snow guard mounted to a portion of a roof in top, front, and perspective view.
Figure 19:
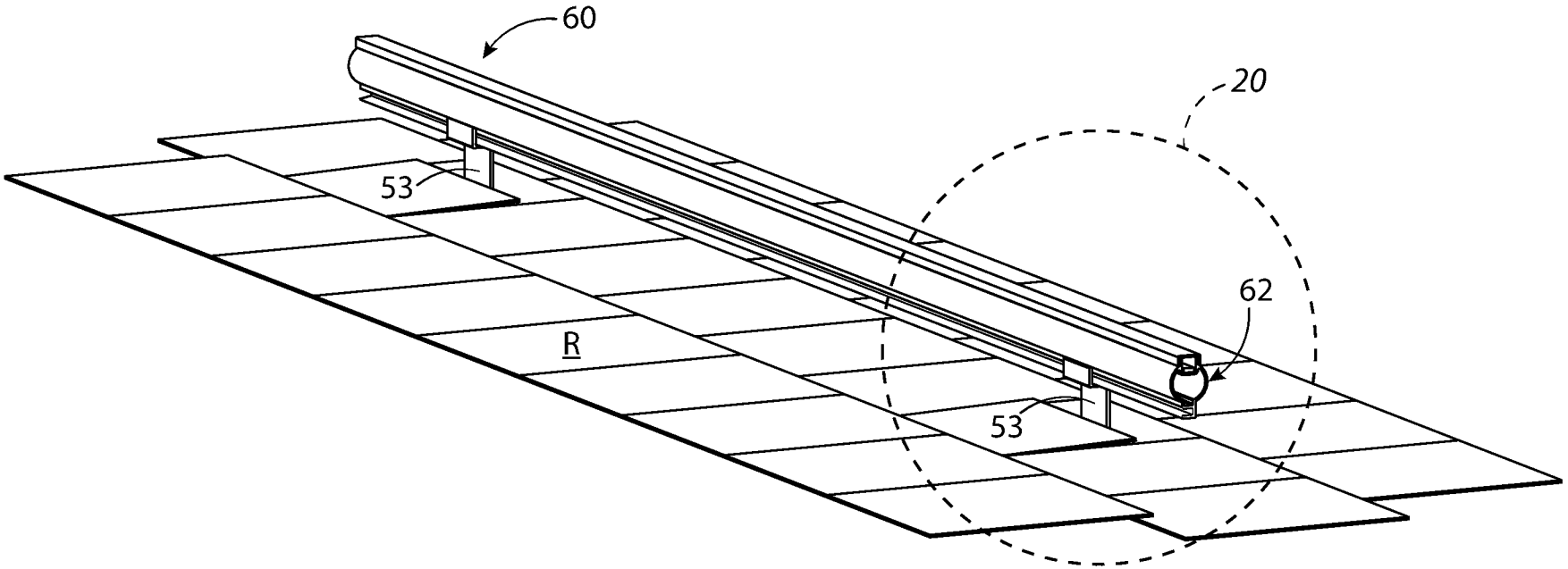
FIG. 19 illustrates a third example of a snow guard mounted to a portion of a tile roof in top perspective view.

Referring to FIGS. 12, 13 and 16-18, 20, and 21, the snow guard tube mounting portion 62*a* can have length-wise grooves 62*b* like those described for FIG. 2. For example, referring to FIGS. 12, 13, 17, 18, 20, and 21, the length-wise grooves 62*b* can be configured to threadedly engage the threaded fastener 54 and secure the mounting bracket 53 (FIGS. 12, 13, 20, and 21) to the snow guard tube 62. The mounting bracket 53 is also shown in FIGS. 11 and 19 and is as described for FIG. 9.

Figure 12:
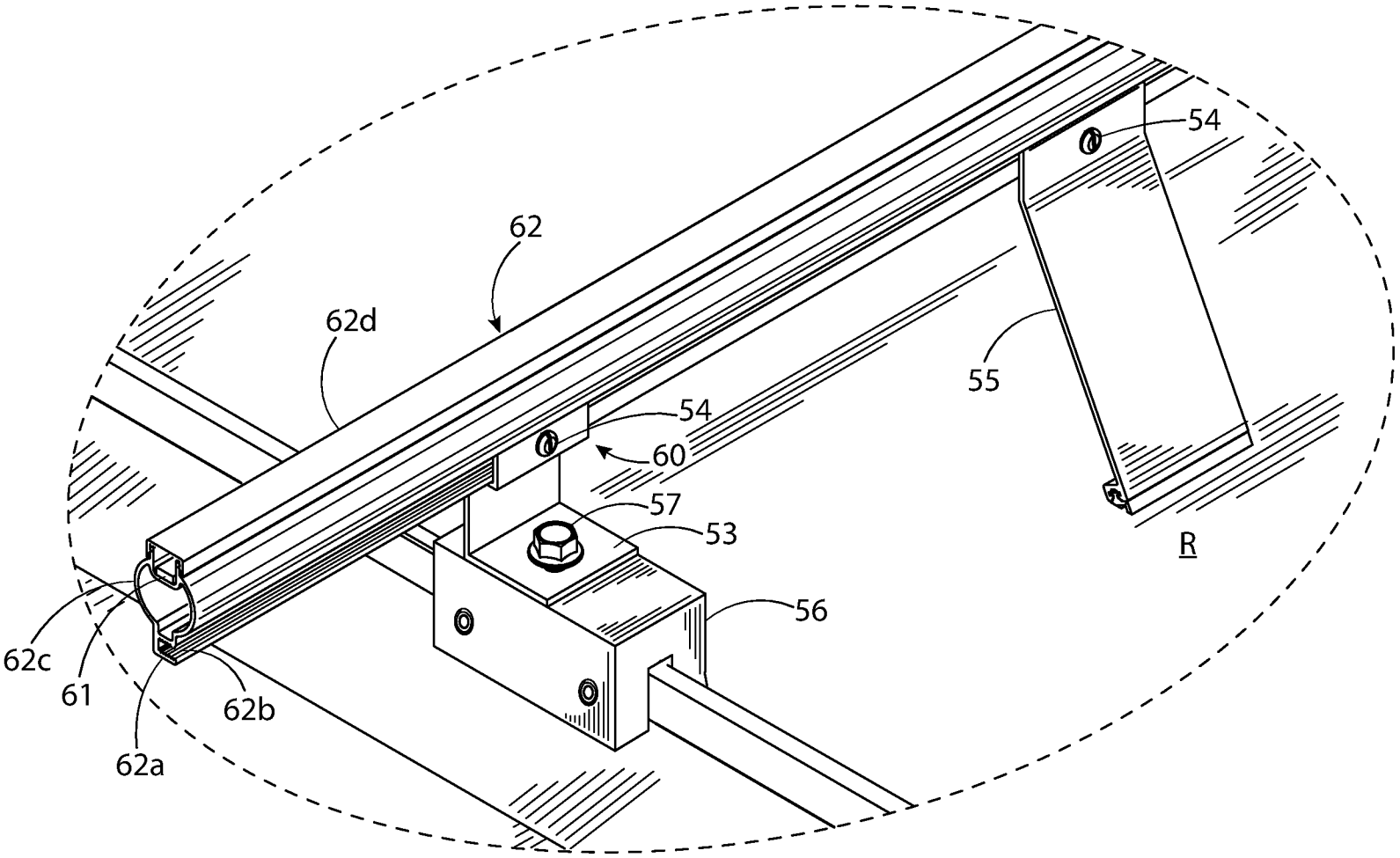
FIG. 12 illustrates a detail view of FIG. 11 indicated in FIG. 11 by the dashed portion called out with the numeral 12 and enlarged to show the end portion of the snow guard in greater detail.

Referring to FIGS. 11-13 and 16, the snow guard assembly 60 is mounted to a roof R. In FIGS. 11, 12, 13, and 16, the roof R is illustrated as a standing seam roof. Referring to FIGS. 12, 13, and 16, the mounting bracket 53 is attached to a standing seam clamp 56 by a threaded fastener 57 as described for FIGS. 2, 3, and 6. Referring to FIGS. 11-13 and 16, optionally, the snow guard clip 55 can provide additional support and help block snow from migrating under the snow guard tube 62. Referring to FIG. 12, the snow guard clip 55 can be identical to or like the snow guard clip described in FIG. 10. A threaded fastener 54 can threadedly engage the length-wise grooves 62*b* secure the snow guard clip 55 to the snow guard tube mounting portion 62*a*.

Figure 20:
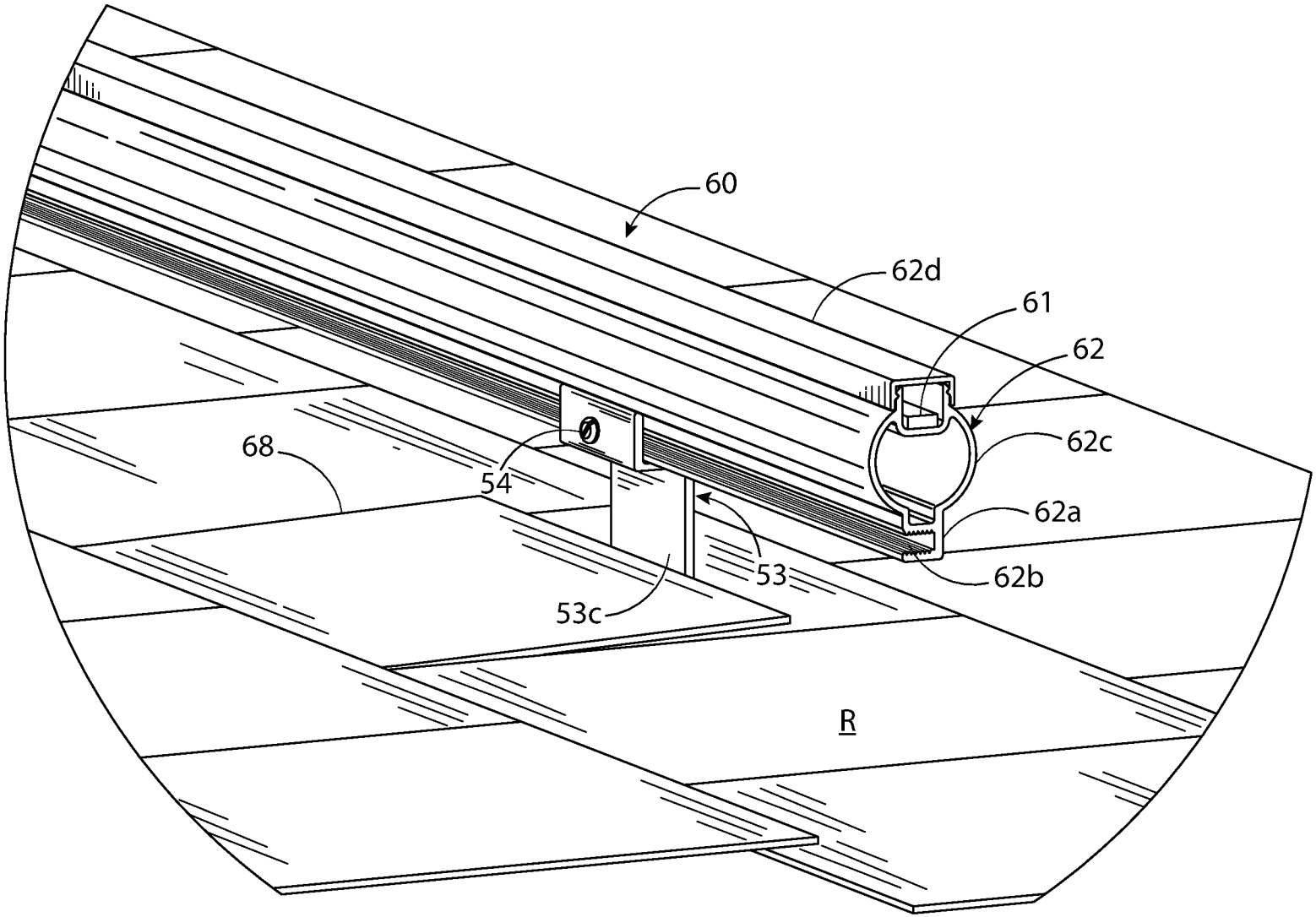
FIG. 20 illustrates a detail view of FIG. 19, indicated in FIG. 19 by the dashed portion called out with the numeral 20, and enlarged to show the end portion of the snow guard in greater detail.
Figure 21:
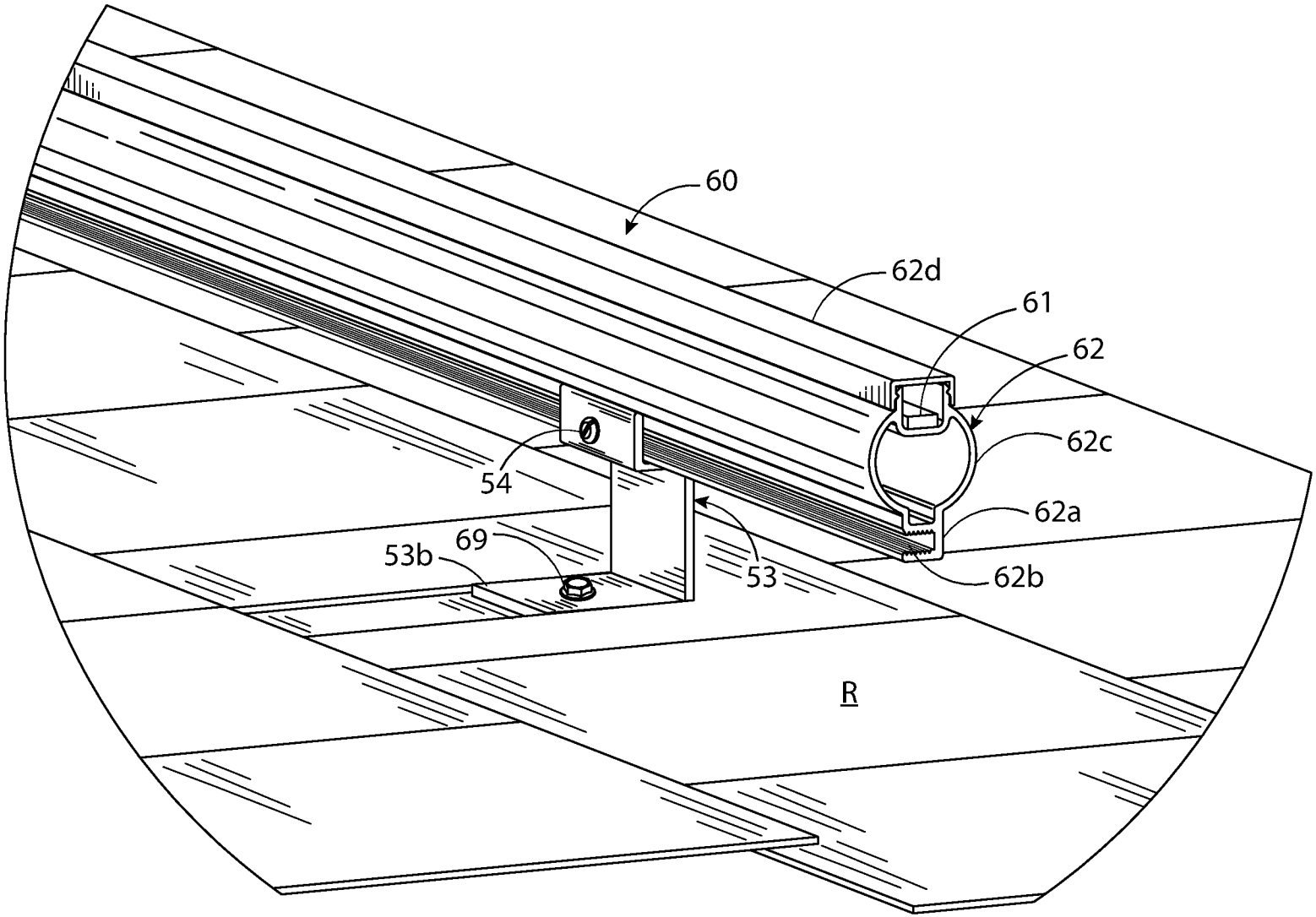
FIG. 21 illustrates the view of FIG. 20 with one of the roofing tiles removed to better illustrate the mounting bracket.

While FIGS. 11-13 and 16 illustrate the snow guard assembly 60 attached to a standing seam roof, it can readily be attached to other roof types. For example, tile roofs, shingle roofs, shake roofs, and concrete roofs. FIGS. 19-21 shows the snow guard assembly 60 is attached to roof R that is a tile roof. FIG. 20 illustrates a detail view of FIG. 19, stated in FIG. 19 by the dashed portion called out with the numeral 20. Referring to FIG. 20, a portion of the mounting bracket base 53*b*, hidden from view, is mounted beneath a roof tile 68. The mounting bracket stem 53*c* extends upward from the roof tile 68. FIG. 21 illustrates the view of FIG. 20 with one of the roofing tiles or roofing shingles removed to better illustrate the mounting bracket 53. Referring to FIG. 21, a threaded fastener 69 secures the mounting bracket base 53*b* to the roof R. The threaded fastener 69 can be a wood screw, bolt, or any other threaded fastener suitable for securing the snow guard assembly 60 to the roof R and capable of withstanding pulling or loosing when the snow guard assembly 60 is under excepted loads from wind, snow, rain. Additional material, such as flashing, roof paper, or elastomeric padding to prevent leaks are well known to those skilled in the art. These additional materials can readily be added as required and can easily be adapted for mounting the snow guard assembly 60 to other roof types such as shake or shingle roofs.

Several ways of directing the heat emitting from the snow guard tube have been described. These include using infrared LEDs as a heating element (FIGS. 2-6), using infrared LEDs combined with a coating 52*f* selectively applied to either reflect or absorb infrared energy (FIG. 7), using multiple chambers combined with one or more heating elements or with a heat retaining medium. In addition, the inventor discovered by varying the thickness of the snow guard tube, he could control the transmission of heat and direct it more efficiently to a particular portion of the snow guard tube.

Figure 22:
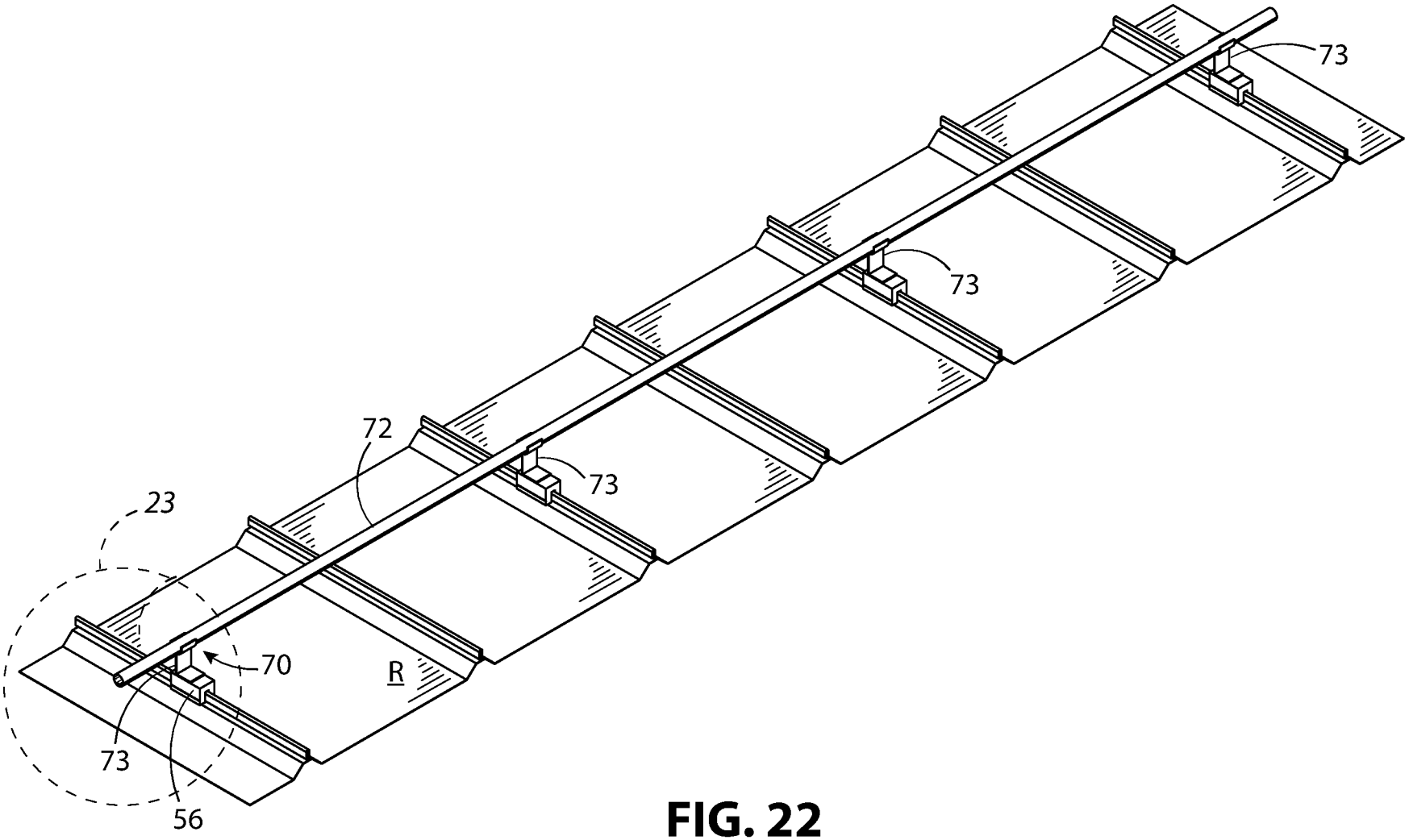
FIG. 22 illustrates a fourth example of a snow guard mounted to a portion of a roof in top, front, and perspective view.
Figure 23:
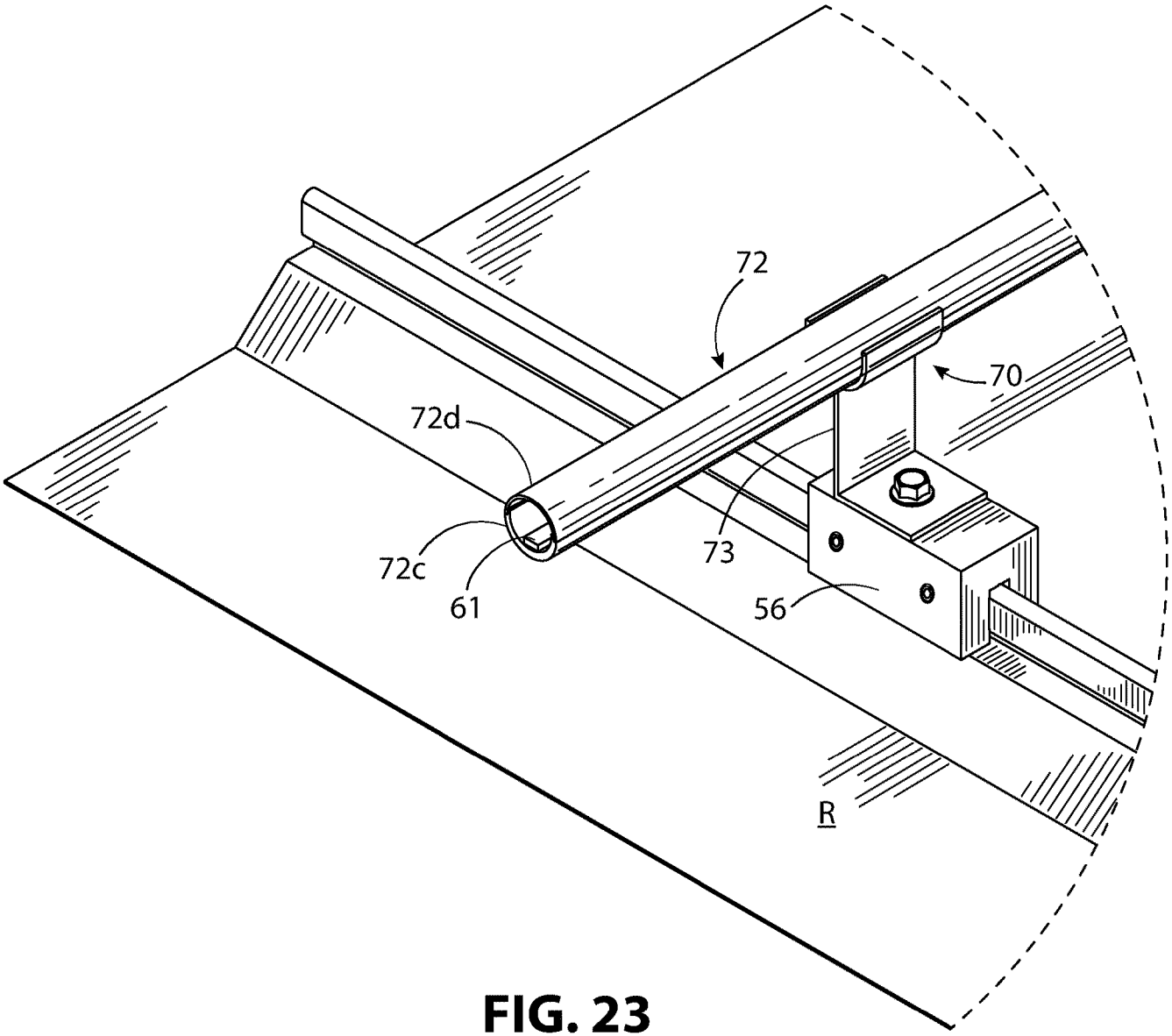
FIG. 23 illustrates a detail view of FIG. 22, stated in FIG. 22 by the dashed portion called out with the numeral 23, enlarged to show the end portion of the snow guard in greater detail.
Figure 24:
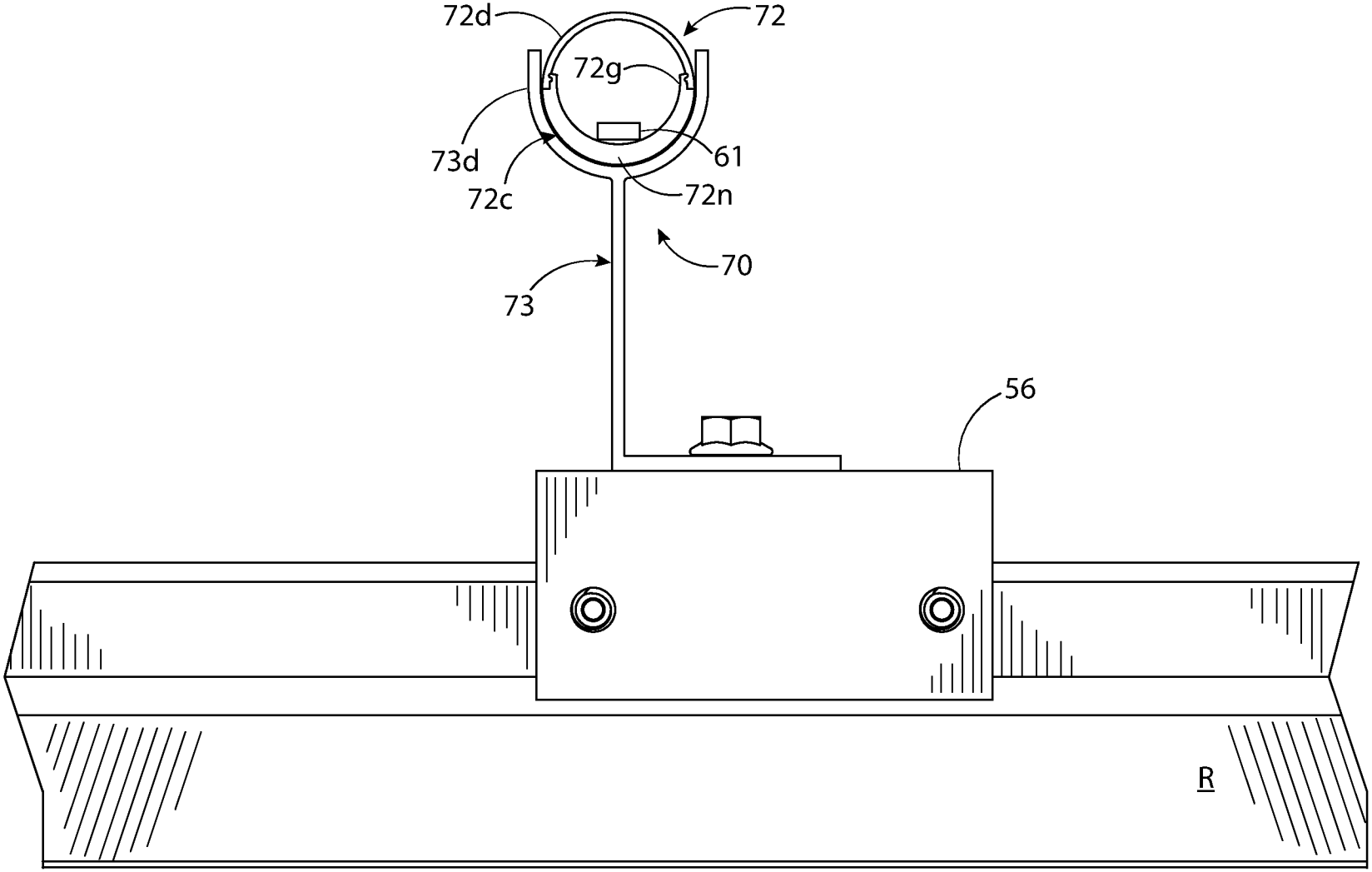
FIG. 24 illustrates a portion of FIG. 22, in side elevation view, showing an enlarged view of the snow guard.
Figure 25:
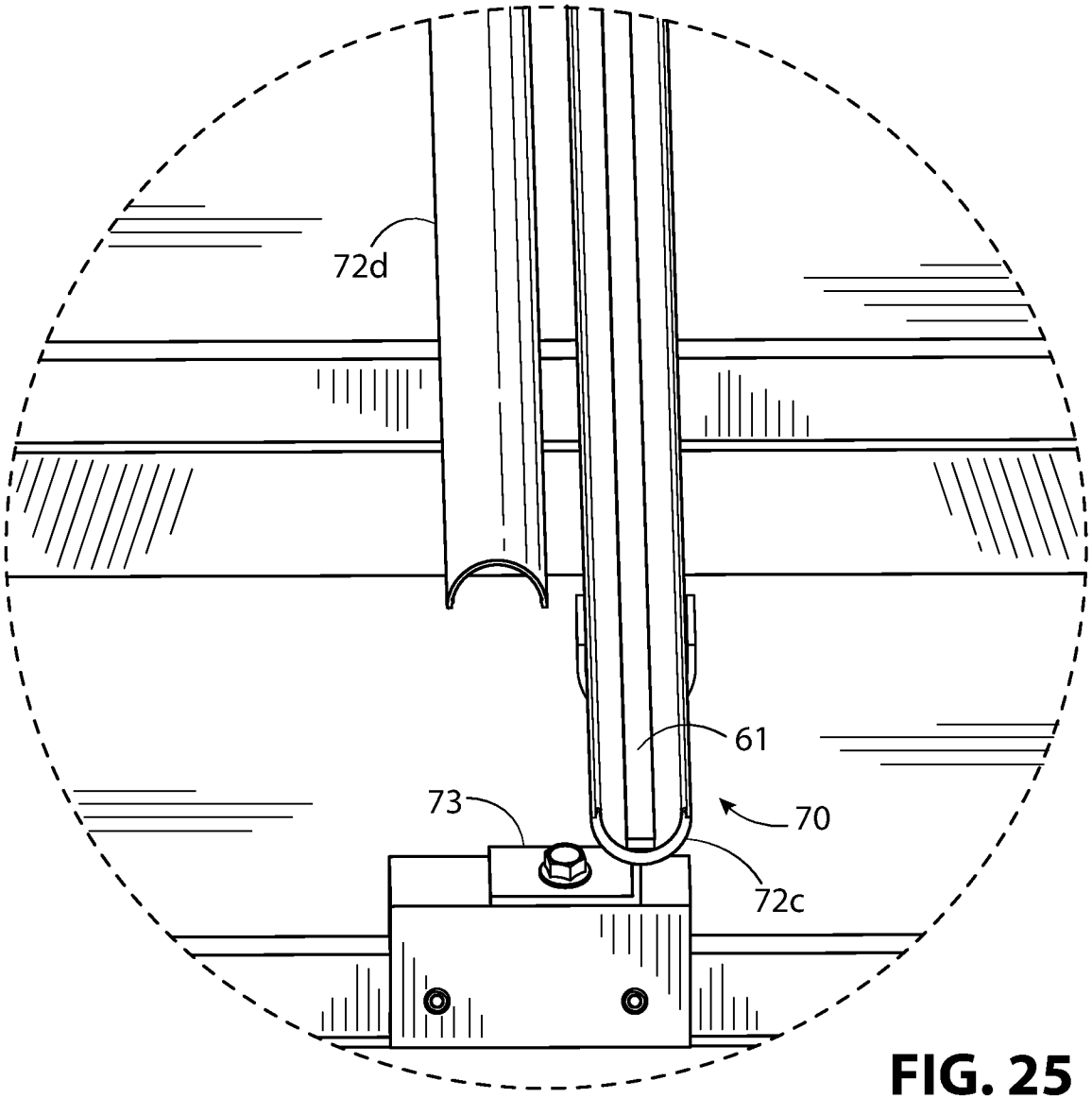
FIG. 25 illustrates a portion of the snow guard of FIG. 22, in top, side, and perspective view, with the snow guard tube in exploded view to show the heating element.
Figure 27:
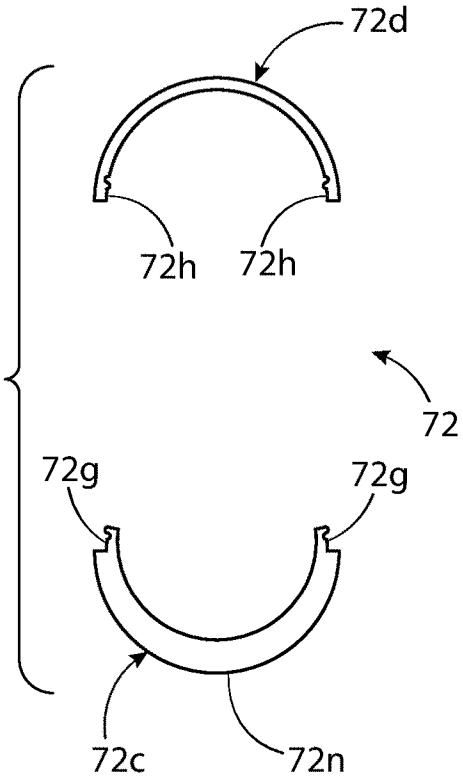
FIG. 27 illustrates the snow guard tube of FIG. 22 in exploded side elevation view.
Figure 26:
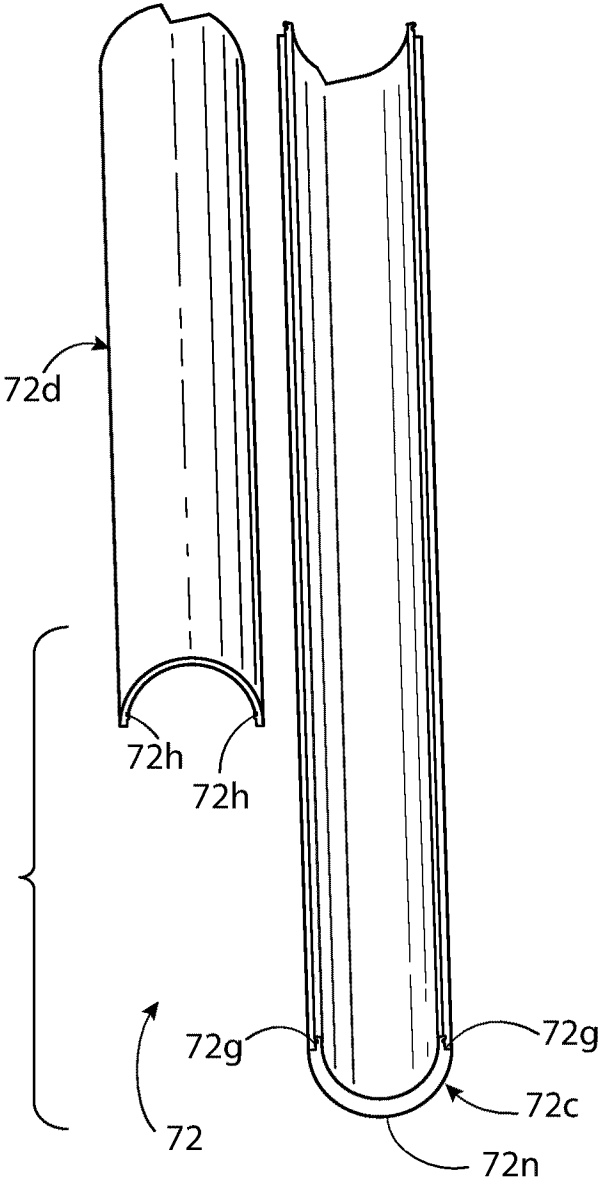
FIG. 26 illustrates a portion of the snow guard tube of FIG. 22, in top, side, and exploded perspective view.

FIGS. 22-29 illustrates a snow guard assembly 70 (FIGS. 22-25) with a snow guard tube 72 (FIGS. 22-27), mounting bracket 73 (FIGS. 22-25, 28, and 29), and heating element 61 (FIGS. 23-25) where the snow guard tube 72 varies in thickness to direct heat. Referring to FIGS. 23-27, the snow guard tube is length-wise separable into a first tube portion 72*c* and a second tube portion 72*d*. Referring to FIGS. 24,26, and 27, the first tube portion 72*c* is illustrated varying in thickness with the thinner portion near the first length-wise edges 72*g* and the thickest portion near the first tube portion bottom area 72*n*. The second tube portion 72*d* is illustrated as having uniform thickness. With the heating element 61 positioned against the inside surface of the first tube portion bottom area 72*n*, the heat will dissipate through the first tube portion bottom area 72*n* into the mounting bracket 73 (FIG. 24) where the tube is thickest.

Figure 28:
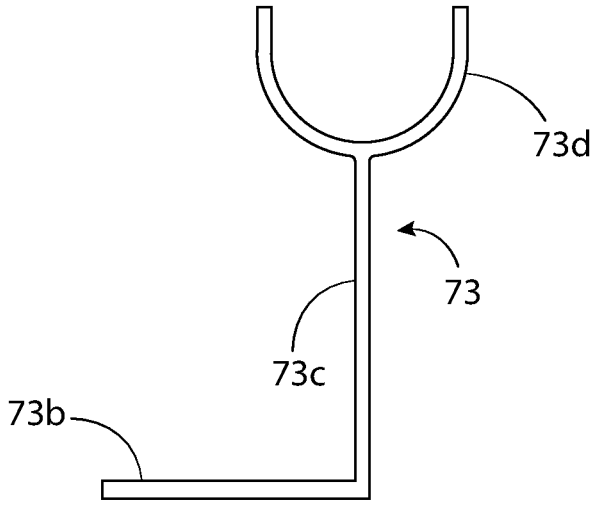
FIG. 28 illustrates the mounting bracket of the snow guard of FIG. 22 in side elevation view.

While the first tube portion 72*c* in FIGS. 23-27 is shown smoothly and continuously changing from a thicker area to a thinner area, i.e. from thick to thin cross section. The change can also be discontinuous, with an immediate transition for thicker area to a thinner area or a thick to thin cross section. The transition from a thicker area to a thinner area, or thick to this cross section, need not be from the first length-wise edge 72*g* to the first tube portion bottom area 72*n* as illustrated in FIGS. 24,27 and 28. For example, the thicker area could be on the side of the snow guard tube 72 facing the snow mound.

The heating element 61 illustrated in FIGS. 23-25 is shown as heat tape or heat trace cable as described for FIGS. 13-16. The inventor envisions that infrared LED strips could be used in place of the heat tape as the heating element 61. The infrared LEDs would dissipate the heat, by conduction, through their diode junctions, as discussed, into the first tube portion bottom area 72*n* (FIG. 24). The infrared LEDs could direct the radiated infrared energy through another portion of the snow guard tube 72. For example, the infrared energy could be directed through a portion of the snow guard tube 72 that faces the snow mound (i.e., the side of the snow guard tube 72 facing the upper portion of the roof). In this example, the radiated infrared energy could be further directed by selectively coating the inside of the snow guard tube 72, like described in FIG. 7, to redirect the heat to a specific part of the snow guard tube 72.

Referring to FIGS. 22-24, the snow guard assembly 70 is mounted to a roof R. The roof is illustrated as a standing seam roof, with the snow guard assembly attached to the roof via a standing seam clamp 56, as described. The snow guard assembly 70 can also be attached to other roof types, such as tile roof, shingle roof, concrete roofs, or shake roofs. For example, the mounting bracket 73 of the snow guard assembly 70 can be attached to a tile roof or shingle roof in a similar manner as discussed for FIGS. 19-21.

Referring to FIGS. 26 and 27, the first tube portion 72*c* and the second tube portion 72*d* can be snapped or otherwise joined. In these figures, the first tube portion 72*c* and the second tube portion 72*d* can be snapped together like what was described for FIGS. 7 and 8. The second tube portion can 72*d* include second length-wise edges 72*h* that snap over the first length-wise edges 72*g* of the first tube portion 72*c*. In FIGS. 26 and 27, the first length-wise edges 72*g* and the second length-wise edges 72*h* include complementary tongue and grooved surfaces to hold the first tube portion 72*c* and the second tube portion 72*d* together. The inventor envisions that other arrangements for holding the first tube portion 72*c* and the second tube portion 72*d* together are possible. For example, the snap together arrangement of FIGS. 7 and 8 can readily be applied to the snow guard tube 72 of FIGS. 26 and 27.

Figure 29:
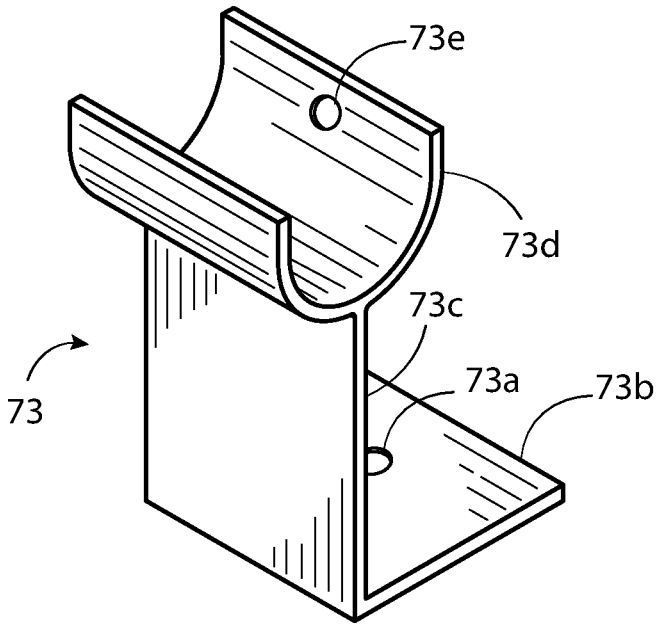
FIG. 29 illustrates the mounting bracket of the snow guard of FIG. 22 in top perspective view.

Referring to FIGS. 22-27, to demonstrate some variations that are possible, the snow guard tube 72 (FIGS. 22-24 and 26-27) is illustrated without a snow guard tube mounting portion, such as the snow guard tube mounting portion 52*a*, 62*a* of FIGS. 3 and 13 respectively. Referring to FIG. 24, the snow guard tube 72 is seated in a tube mounting portion 73*d* of the mounting bracket 73. The tube mounting portion 73*d* is sized and shaped to hold the snow guard tube 72. For example, the tube mounting portion 73*d* of the mounting bracket 73 can be u-shaped, arcuate shaped, or radiused to hold the snow guard tube 72. Referring to FIGS. 28 and 29, the mounting bracket 73 can also include a mounting bracket stem 73*c* that extends downward from the tube mounting portion 73*d* and a mounting bracket base 73*b* that extends from the mounting bracket stem 73*c*. For example, the mounting bracket base 73*b* can extend perpendicularly, as illustrated, or obliquely away from the mounting bracket stem 73*c*. Referring to FIG. 29, The mounting bracket base 73*b* can include an aperture 73*a* sized and shaped to receive a threaded fastener. For example, a screw or bolt for securing the mounting bracket 73 to a standing seam clamp, a concrete roof, or a wood beam in a shingle, tile, or shake roof. The tube mounting portion 73*d* can optionally include an aperture 73*e* to receive a threaded fastener that can secure the tube to the tube mounting portion.

FIGS. 30-39 illustrate various parts and optional mounting portions of a snow guard assembly 80 (FIGS. 30-33, 38, and 39) where the snow guard tube 82 (FIGS. 30-33, 36-39) includes a rectangular cross section and a backstop 82*p* (FIGS. 31-33, 36-39) that extends above the rectangular cross section. Referring to FIGS. 31-33, 36, 37, and 39, the snow guard tube 82 is length-wise separable into a first tube portion 82*c* and a second tube portion 82*d*. The first tube portion 82*c* and the second tube portion 82*d* are each illustrated as having an L-shaped cross section so that together they form a rectangular cross section. The L-shaped cross section of the first tube portion 82*c* includes a first tube portion bottom area 82*n* forming a first leg of the L-shaped cross section and a backstop 82*p* extending upward from the first tube portion bottom area and forming a second leg of the L-shaped cross section. One advantage of this snow guard tube is the backstop 82*p*. The backstop 82*p* can act as a snow fence and can extend upward any desired height. The inventor envisions that the second tube portion 82*d* can also be arcuate shaped, linear, or a section of polygon where the first tube portion 82*c* and the second tube portion 82*d* together form other cross-sectional shapes. The snow guard tube 82 typically has an enclosed cross section and an enclosed perimeter surface as illustrated and can have optional end caps (not shown) to create an enclosed air space.

Figure 37:
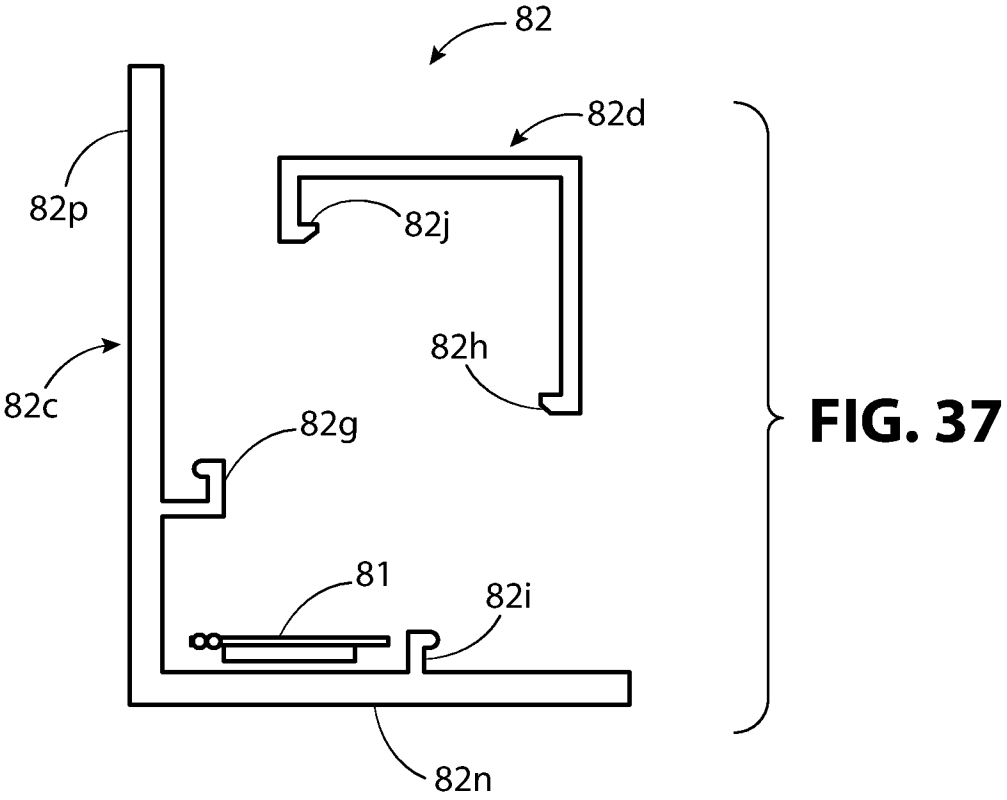
FIG. 37 illustrates a portion of the snow guard tube of FIG. 30, in exploded side elevation view.

Referring to FIG. 37, the first tube portion 82*c* and the second tube portion 82*d* can snap together, captively slide together, or as illustrated, hook and snap together. For example, the first tube portion 82*c* can include a first tube portion first edge 82*g* that hooks into the second tube portion first edge 82*j*. The second tube portion second edge 82*h* can snap into the first tube portion second edge 82*i*. The first tube portion first edge 82*g* and the first tube portion second edge 82*i* extend length-wise along the first tube portion 82*c*. The second tube portion first edge 82*j* and the second tube portion second edge 82*h* extend length-wise along the second tube portion 82*d*. The first tube portion first edge 82*g* is illustrated as j-shaped with the stem of the j-shape extending away directly away from the backstop 82*p* of the first tube portion 82*c*. The first tube portion first edge 82*g* is positioned between the vertex of the backstop 82*p* and the first tube portion bottom area 82*n* and the end of the backstop 82*p*. The first tube portion second edge 82*i* is positioned between the vertex of the backstop 82*p* and the first tube portion bottom area 82*n* and the end of the first tube portion bottom area 82*n*. The second tube portion first edge 82*j* and the second tube portion second edge 82*h* are at distal ends of the second tube portion 82*d*.

Figure 36:
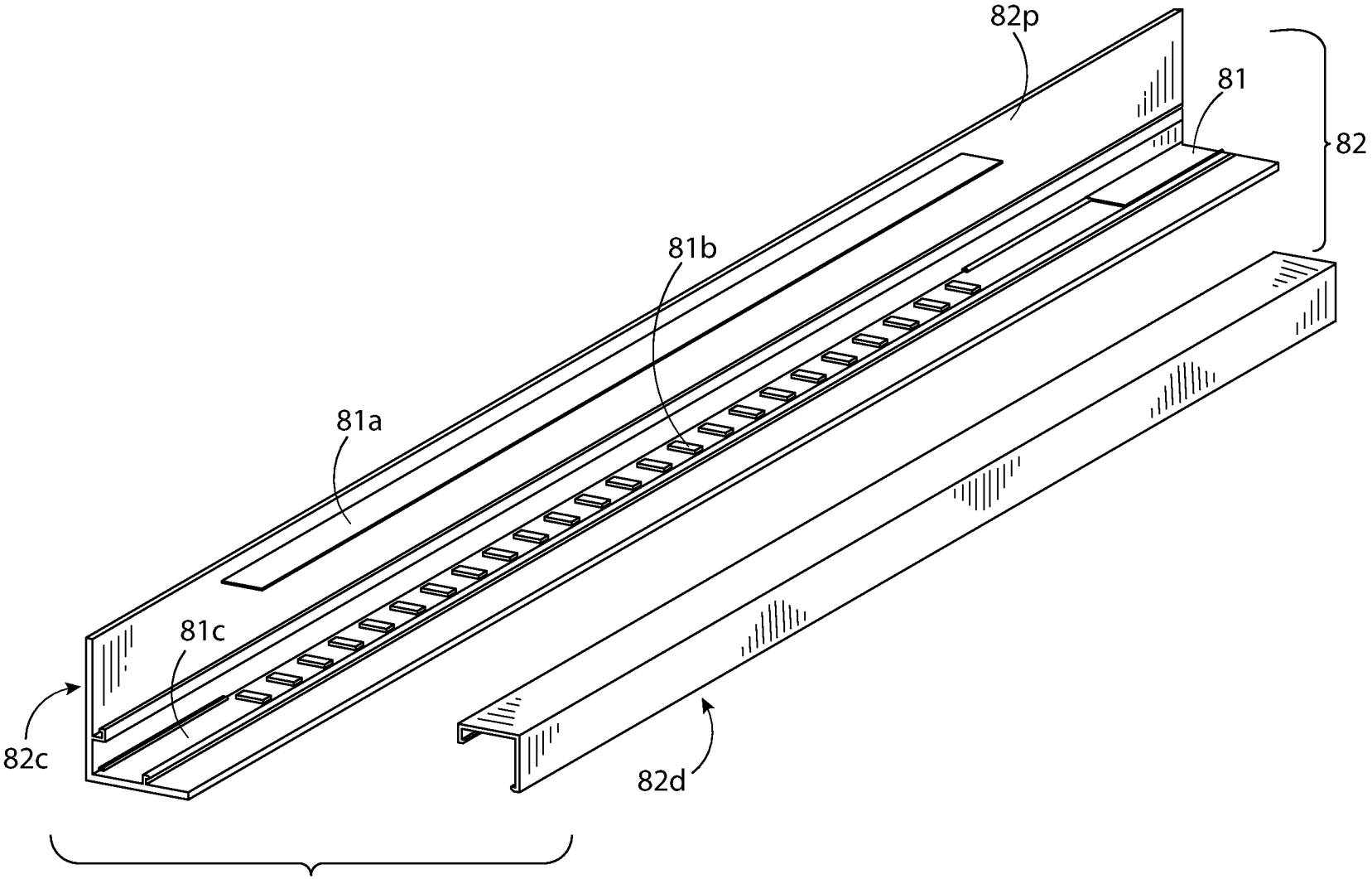
FIG. 36 illustrates a portion of the snow guard tube and infrared LED lighting assembly of FIG. 30, in top exploded perspective view.

Referring to FIGS. 32, 33, 36, 37, and 39, the heating element 81 is illustrated as a strip of infrared LEDs. This strip is illustrated as flat, although the strip could have a circular cross section as illustrated. FIG. 36 illustrates typical construction of the heating element as an infrared LED strip. Referring to FIG. 36, the heating element 81 is shown with the cover 81*a* exploded away to reveal the infrared LEDs 81*b* and circuit strip 81*c*. As discussed, LEDs generally dissipate heat through their diode junction that is positioned below the light emitting portion. In FIG. 36, the infrared LEDs 81*b* dissipate waste heat into the circuit strip 81*c* and into the first tube portion 82*c*. One advantage of the heating element 81 being an infrared LED strip is that the infrared radiation can be directed toward a specific portion of the snow guard tube 82. For example, the infrared radiation from the infrared LEDs 81*b* can be directed toward the backstop 82*p*. With the waste heat from the LED diode junction directed toward the bottom of the first tube portion 82*c* and the infrared radiation being directed toward the backstop 82*p* (i.e., the back of the first tube portion), most of the heat energy can be directed toward the first tube portion 82*c*.

Figure 35:
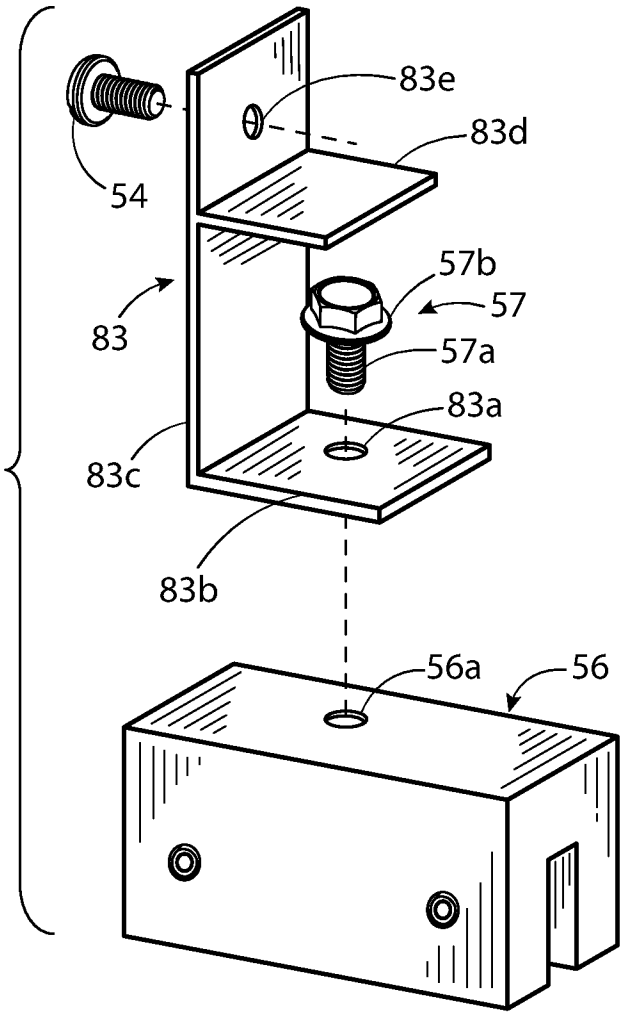
FIG. 35 illustrates the snow guard mounting bracket and the standing seam clamp of FIG. 30 in top and exploded perspective view.

Referring to FIGS. 30-33, the snow guard assembly 80 is shown attached to a roof R that is a standing seam roof. The snow guard tube 82 is attached to a mounting bracket 83 that can attach to the standing seam roof by a standing seam clamp 56. Referring to FIGS. 31-35 the mounting bracket 83 is secured to the standing seam clamp 56 by a threaded fastener 57 (FIGS. 32-35). Referring to FIG. 35, the threaded fastener body 57*a* passes through an aperture 83*a* in the mounting bracket base 83*b* and threadedly engages the aperture 56*a* in the standing seam clamp 56. The threaded fastener shoulder 57*b* seats against the mounting bracket base 83*b*.

The snow guard assembly 80 can mount to other roof surfaces. For example, referring to FIGS. 38 and 39, the snow guard assembly 80 is mounted directly to a roof R such as concrete or sheet metal. The snow guard assembly 80 can also be mounted in a similar way to shingle roofs. Referring to FIG. 39, threaded fasteners 59 secures the snow guard to the roof R. The threaded fasteners 59 extend through a flange 82*q*, or lip, of the first tube portion bottom area 82*n* that extends beyond the second tube portion 82*d*. A water-resistant membrane, such as ethylene propylene diene monomer (EPDM), rubber, or other elastomers can be placed between the first tube portion bottom area 82*n* and the roof R to help keep the roof water tight. As illustrated in FIGS. 38 and 39, the snow guard assembly 80, may not a separate mounting bracket. Optionally, flashing, or flashing combined with a water-resistant membrane may also be used. This may be especially helpful for mounting the snow guard assembly 80 to a shake or shingle roof.

Figure 32:
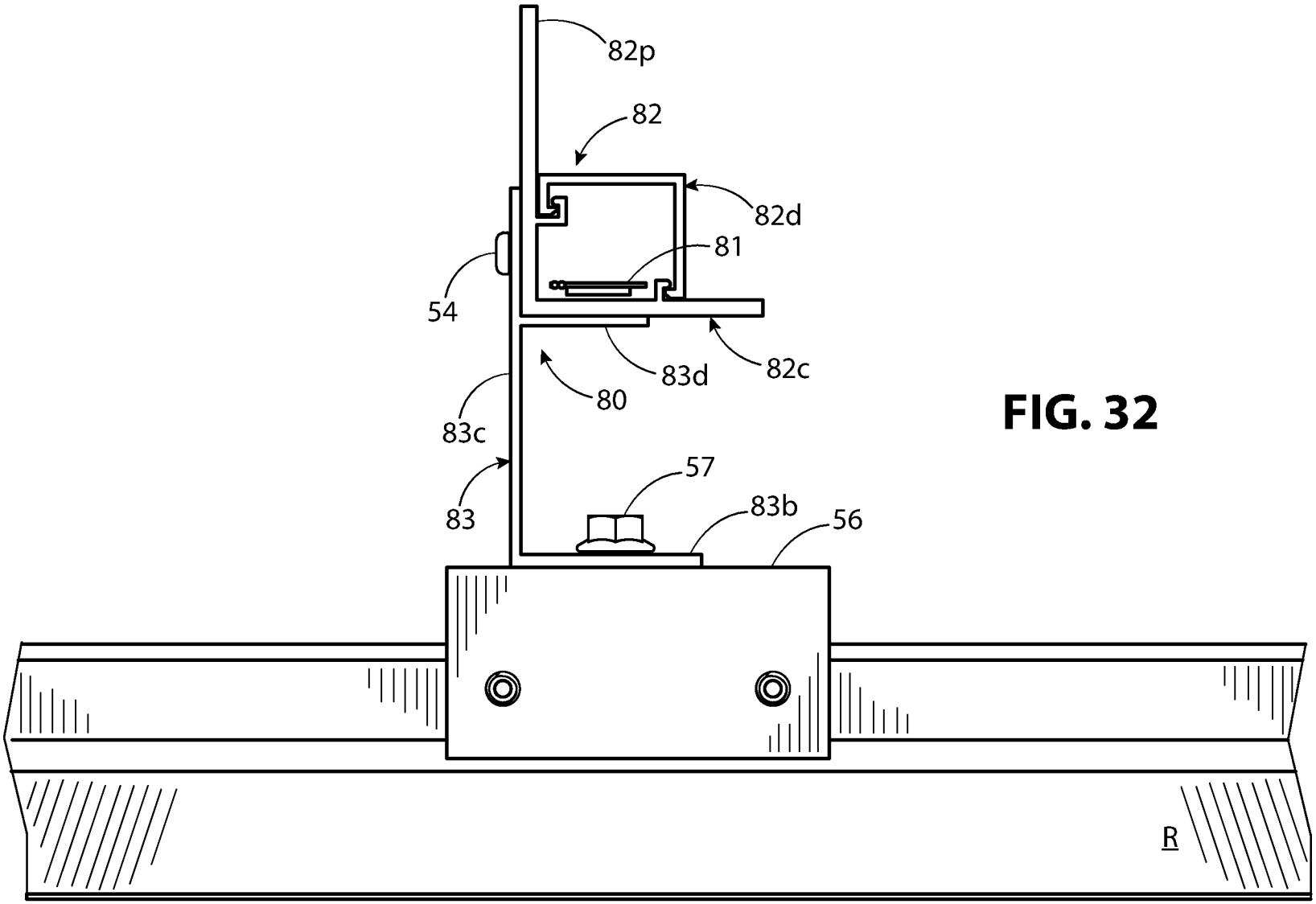
FIG. 32 illustrates a portion of FIG. 30, in side elevation view, showing an enlarged view of the snow guard.
Figure 33:
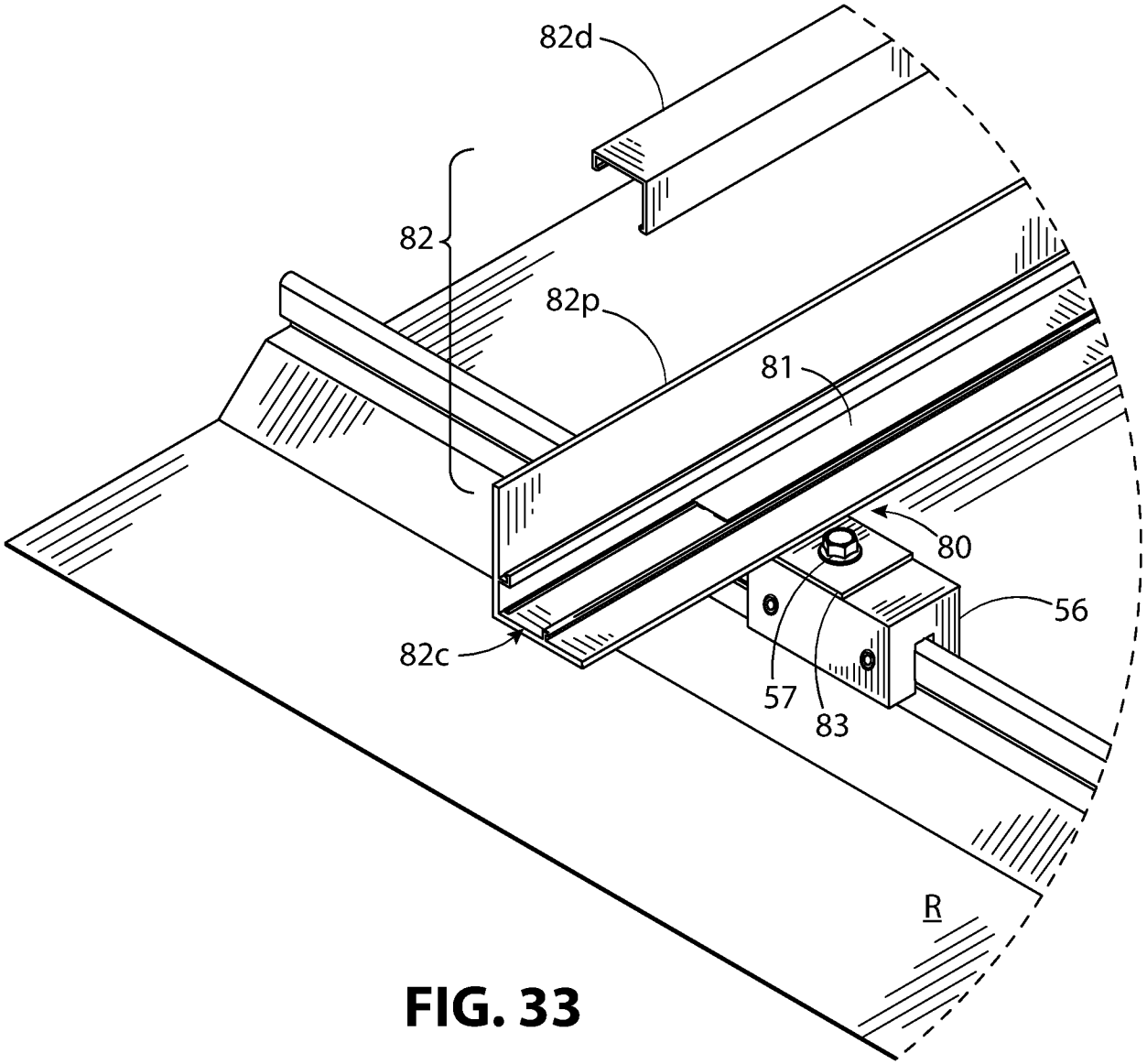
FIG. 33 illustrates a portion of the snow guard of FIG. 30, in top, front, and perspective view, with the snow guard tube in exploded view to show the heating element.
Figure 34:
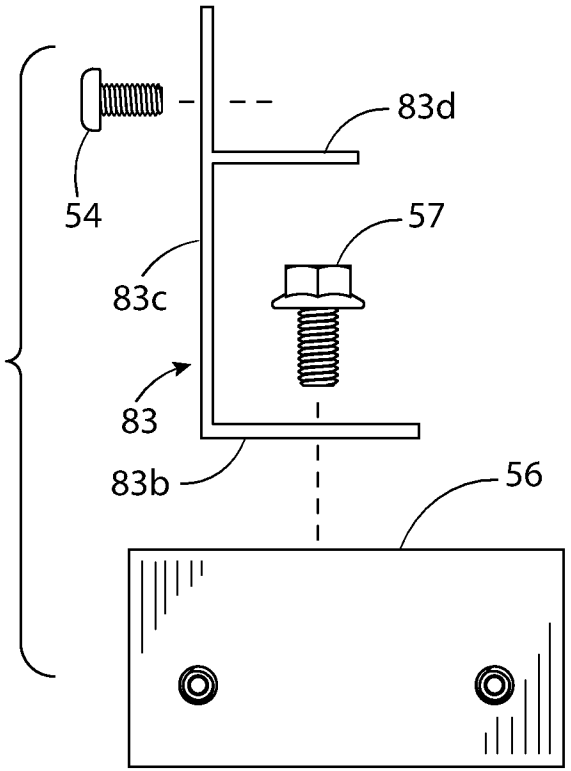
FIG. 34 illustrates the snow guard mounting bracket and a seam clamp assembly of FIG. 30 in side elevation view.

Referring to FIGS. 32, 34, and 35, the snow guard tube 82 (FIG. 32) can be secured to the mounting bracket 83 by a threaded fastener 54 through an aperture 83*e* (FIG. 35) in the mounting bracket 83. The snow guard tube 82 rests against both the mounting bracket stem 83*c* that projects vertically upward from the mounting bracket base 83*b*, rests against a mounting bracket shelf 83*d* that projects horizontally outward from the mounting bracket stem 83*c*.

The inventor discovered that he could mix strings of infrared LEDs with a visible light source, such as visible light emitting LEDs, to create a snow guard that was both heated and could display words and patterns. FIGS. 40-43 illustrates a simple example of this. Referring to FIGS. 40-43, the snow guard assembly 90 (FIGS. 40 and 41) and the snow guard tube 92 is similar in structure to the snow guard assembly 50 and snow guard tube 52 of FIG. 1. The snow guard tube 92 can be length-wise separable as previously described. Referring to FIGS. 40 and 41, the snow guard tube 92 can include a snow guard tube mounting portion 92*a* mounted to a mounting bracket 53 as described. In addition, the mounting bracket 53 can be secured to a shake, tile, shingle or concrete roof as discussed, or to a standing seam roof by a standing seam clamp 56. The snow guard tube 92 is can be structured the same as snow guard tube 52 of FIG. 1 except for adding cutouts 92*r*, 92*s*, 92*t*. The infrared LEDs can be arranged so they heat the tube by both waste heat conduction and by infrared radiation as discussed. Except for the cutouts, the snow guard tube 92 typically has an enclosed cross section and an enclosed perimeter surface as illustrated and can have optional end caps (not shown) to create an enclosed air space as previously discussed. The cutouts can optionally be covered with an optically clear material such as acrylic or polycarbonate to air seal or water seal the snow guard tube 92. The visible light source (e.g., visible light emitting LEDs) can be arranged so they shine light through the cutouts 92*r*, 92*s*, 92*t*. Visible light sources other than visible light emitting LEDs can be used, for example, low power incandescent or quartz light strings, however, visible light emitting LEDs have several advantages. They can dissipate their waste heat from their diode junction, by conduction, directly to the snow guard tube 92. They are more efficient than incandescent or quartz light sources. They can use the same low voltage power source as the infrared LEDs, which simplifies wiring. Note that the snow guard tube can be lengthwise separable, can be a continuous tube or can have removable portions spaced apart along the tube for servicing.

In FIG. 40, the roof R is shown to include glass panels 100, such as in a sun room, green house, or skylight. The light shining through the cutouts 92*r*, 92*s*, 92*t* projects onto the glass panels 100, creating one or more of projected words 101 and projected patterns 102, 103. Referring to FIGS. 40-43, the cutouts 92*r* (FIGS. 40-42) and the cutouts 92*s*, 92*t* (FIGS. 40, 41, and 43) are backward so the projected words 101 (FIG. 40) and projected patterns 102, 103 (FIG. 40) can be seen correctly from below through the glass panels 100 (FIG. 40). Referring to FIG. 40, if the roof R were made of an opaque material (i.e., opaque to visible light), the cutouts 92*r*, 92*s*, 92*t*, would be oriented in a normal direction (i.e., not backward or not reversed).

The snow guard assemblies 50, 60, 70, 80, 90 of FIGS. 1, 11, 22, 30, and 40, respectively can have their heating element controlled by a controller such as an automation controller or other electronic or electro-mechanical control system. FIGS. 44 and 45 illustrate an example of an automation control system that can control the snow guard assemblies 50, 60, 70, 80, 90 of FIGS. 1, 11, 22, 30, and 40, respectively. FIG. 44 shows a flow chart 110 and FIG. 45 a system diagram of the snow guard control system 120. Referring to FIG. 45, the heating element 122 can be wired in a single zone or two or more zones within the snow guard tube 123 with a corresponding single snow sensor or two or more snow sensors. In FIG. 45 the heating element 122 is illustrated as infrared LEDs arranged in infrared LED zone one 124, infrared LED zone two 125, and infrared LED zone three 126. A system controller 121 can separately drive infrared LED zone one 124, infrared LED zone two 125, and infrared LED zone three 126 based on feedback control from a snow sensor 127, 128, 129 positioned in zone one, zone two, and in zone three, respectively. Each of the snow sensors 127, 128, 129 can be simple pressure sensors placed against the side of the snow guard tube 123, the snow guard clip (not shown), or the snow guard mounting bracket (also not shown). Alternatively, a snow depth sensor can be used instead of a pressure sensor. For example, the snow sensor could be ultrasonic snow depth sensor, acoustic snow depth sensor, or an opto-electric snow depth sensor (e.g., laser or infrared opto-electric sensing). The system controller can be an off-the-shelf automatic controller, or a custom system controller with sensor inputs and driver outputs suitable for the driving the heating element 122 or other heating elements discussed throughout this disclosure such as heating elements 51, 61, 81 exemplified in FIGS. 2, 12, 36 respectively. The system controller 121 can include a processor such as microprocessor, microcontroller, field programable gate array (FPGA), application specific integrated circuit (ASIC), programable logic device (PLD) or any other processor capable of performing the described tasks. The processor would typically receive the output signals from the snow sensors 127, 128, 129 in ways known in the art, for example, directly, via one or more analog-to-digital converters (ADCs), via a buffer circuit, or via digital transmission protocol (e.g., USB, Thunderbolt, Bluetooth, Ethernet, 802.11, Zigbee, Z-Wave, BACnet, KNX, X10, and the like) if the sensor outputs a digital signal. The processor would typically drive infrared LED zone one 124, infrared LED zone two 125, and infrared LED zone three 126, either directly or through an external driver circuit suitable providing the necessary current for driving a heating element.

Referring to FIGS. 44 and 45, where steps refer to FIG. 44, and system elements refer to FIG. 45, in a typical control scenario, in step 111, the system controller 121 receives the signals 127*a*, 128*a*, 129*a* from snow sensors 127, 128, 129, respectively. The number of zones and sensors depend on the sophistication of the system. For example, the system could have a single zone or two or more zones (i.e., n number of zones). In step 112, the sensor signal levels are compared with predetermined values for each zone stored within the controller's memory or stored in a remote server, computer, or mobile device. In step 113, the comparison is performed, and for each zone, the controller determines whether adjustment is required. Other factors can come into play, for example, air temperature, weather forecast, or precipitation (i.e., rain, hail, sleet, or snow). If adjustment is not required, the process is repeated at a predetermined interval. If adjustment is required in one zone or the two or more zones, in step 114, the system controller 121 sends out a signal to drive the heating element in the corresponding zone. As discussed in the previous paragraph, the system controller 121 can either drive the heating elements directly or via an intermediate driver such as a transistor-based driver, a metal oxide field-effect transistor driver (MOSFET), or an integrated circuit driver.

Figure 30:
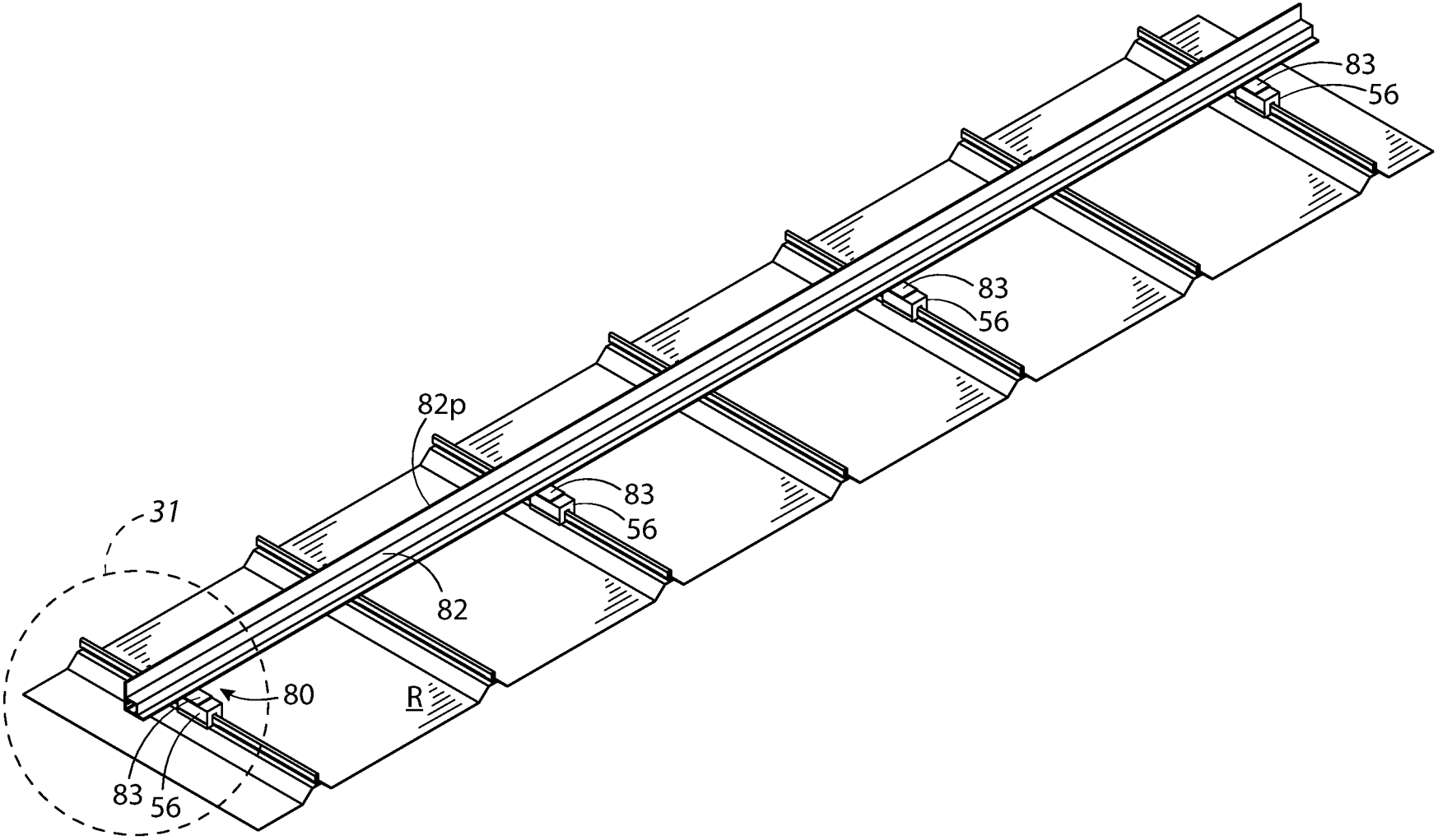
FIG. 30 illustrates a forth example of a snow guard mounted to a portion of a roof in top, front, and perspective view.
Figure 31:
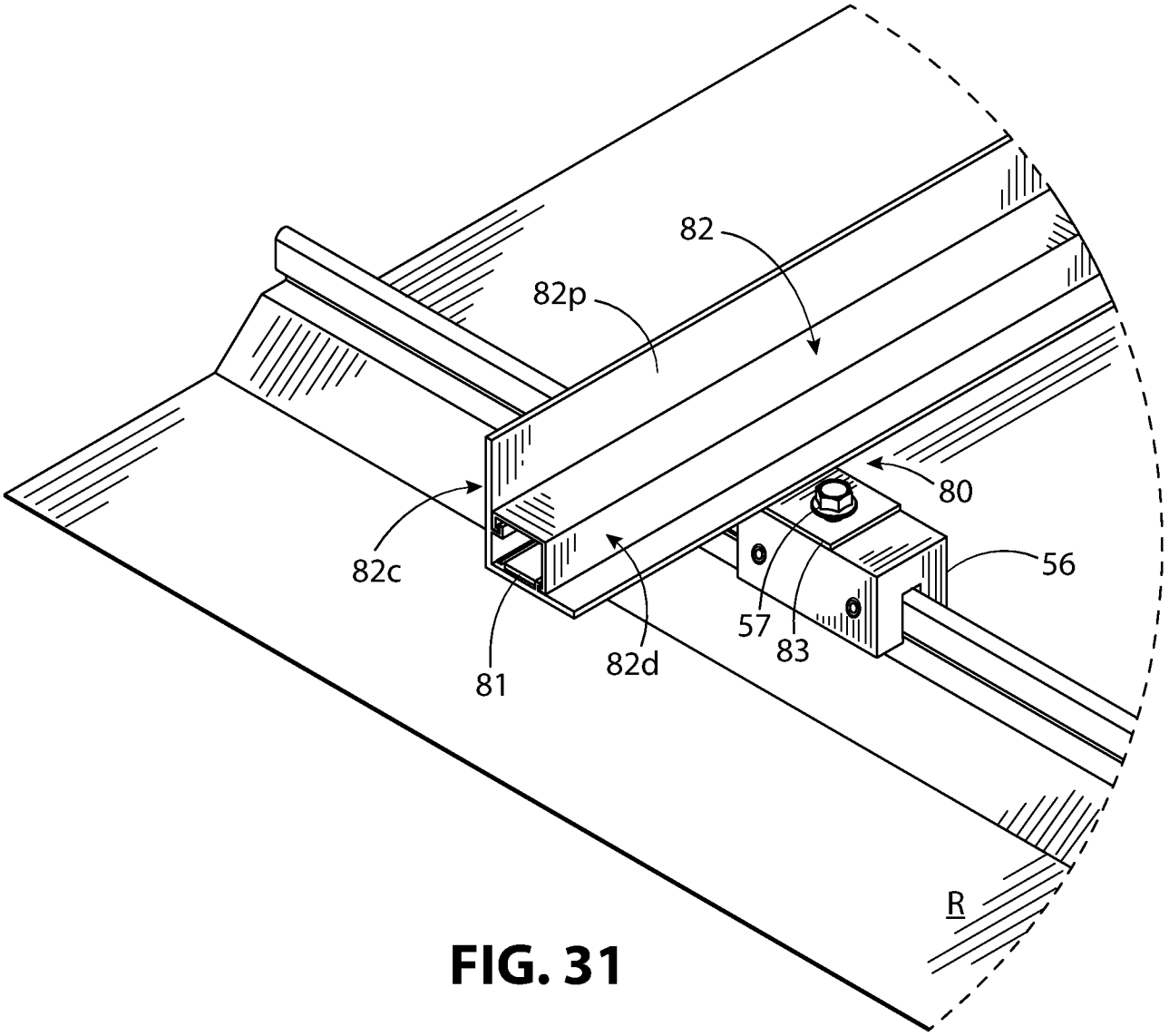
FIG. 31 illustrates a detail view of FIG. 30, indicated in FIG. 30 by the dashed portion called out with the numeral 31, and enlarged to show the end portion of the snow guard in greater detail.

A snow guard and snow guard assembly has been described. This disclosure does not intend to limit the claimed invention to the examples or variations described in the specification. Those skilled in the art will recognize that variations will occur when embodying the claimed invention in specific implementations and environments. For example, each of the snow guard assemblies 50, 60, 70, 80, 90 exemplified in FIGS. 1, 11, 22, 30, and 40, respectively can be adapted to attached to other roof types. For example, the snow guard assemblies 50, 70, 90 of FIGS. 1, 30, and 40, respectively, are shown mounted to standing seam roofs. The snow guard assemblies 50, 70, 90 can be mounted to shingle, tile, shake, and concrete roofs in a similar manner as snow guard assembly 60 of FIG. 11 mounting to a tile or shingle roof in FIGS. 20-22. The snow guard assemblies 80 of FIG. 30 shown attached to a standing seam roof, is also illustrated attached to other roof types in FIGS. 38 and 39. The snow guard assemblies 50, 60, 70, 80 of FIGS. 1, 11, 22, and 30, respectively, can be mounted to transparent or translucent roof panels as illustrated in FIG. 40. The transparent or translucent roof panels are typically constructed from glass, acrylic, or polycarbonate but can be constructed from other transparent or translucent roof panels.

It is possible to implement certain features described in separate examples in combination within a single example. Similarly, it is possible to implement certain features described in single embodiments either separately or in combination in multiple embodiments. The inventor envisions these variations fall within the scope of the claimed invention.

For example, variations of the snow guard control system 120, such as the one described for FIG. 45 can be applied to the snow guard assemblies 50, 60, 70, 80, 90 of FIGS. 1, 11, 22, 30, and 40, respectively. The snow guard assembly 50 of FIGS. 1-3, could include heating elements 51 (FIGS. 2-6) other than the infrared LED heating element shown. It could be modified to accept a quartz infrared heating tube or other radiant infrared emitters or infrared light sources, as well as heating tape or heating wire. In FIGS. 12-16, 20, and 21, an additional heating element can be positioned in the lower portion 62*j* (FIG. 13) of the snow guard tube 62. For example, this additional heating element can the heating element 51 of FIGS. 2-6, or heating element 81 of FIGS. 31-33, 36, 37, and 39. This configuration can selectively optimize heating of specific portions the snow guard assembly 60 of FIGS. 11-13 and 19-21 that heated.

When switching between conduction type heating elements, and infrared heating elements differences between the two types of heating elements should be appreciated and is not simply substitution. Conduction type heating elements, like heat tape or heating wire, transfer heat by direct contact with a heat conductive medium. For example, direct conduction to with metal snow guard tube or heating the air space surrounding the heating element. Infrared LEDs, conduct waste heat through their diode junction and through radiating infrared radiation (i.e., infrared light) onto a heat conducting medium such as the snow guard tube. In addition, radiant infrared emitters can generate heat that is used for conduction or convention but primarily are designed to direct infrared radiation outward. These differences can dictate design choices and are non-obvious. However, designing for each type of heating element or combinations of each should be clear from the examples described within this disclosure. For example, when using radiant infrared emitters or infrared light sources primarily using near infrared, it may be advantageous to make the snow guard tube opaque to both the near infrared emitted by radiant infrared emitter or infrared light source. This allows the tube to absorb the heat and, depending on the material, reradiate the far infrared. This also allows the use materials, such as aluminum or steel, that are also visible light opaque. Using far infrared radiant infrared emitters or infrared light sources, it may be advantageous to use a material for the snow guard tube that is transparent to far infrared to melt the snow directly. Examples of such materials include ceramic oxides which are transparent to far infrared, but opaque to visible light.

The concept of varying the thickness of the snow guard tube 72 to heat optimizing heating of specific area of the snow guard tube or even the snow guard assembly 70, as discussed for FIGS. 22-27 can be applied to the other examples. For example, the snow guard tube 52 of FIGS. 2-8, the snow guard tube 62 of FIGS. 11-21, and the snow guard tube 82 of FIGS. 30-39, and the snow guard tube 92 of FIGS. 40-43, all can have walls of varying thickness to optimizing heating of certain portions of their respective snow guard tubes as discussed for the snow guard tube 72 of FIGS. 22-27.

The snow guard tubes 52, 62, 72, 82, 92 of FIGS. 1, 11, 22, 30, and 40, respectively, are typically made of a heat conductive material such as aluminum, steel, or other metals. These materials are typically opaque to various bands of infrared light as well as visible light. Their corresponding first tube portions and second tube portions can be typically extruded but could be stamped, rolled, cast, or otherwise formed. While the snow guard tubes 52, 62, 72, 82, 92 are illustrated as lengthwise separable, they can alternatively continuous. They can alternatively include removable portions that are spaced apart for servicing the snow guard components.

FIG. 7 described applying a coating 52*f* applied to the snow guard tube 52. The coating 52*f* can be infrared absorbing or infrared reflecting to selectively direct or redirect infrared radiation. The coating 52*f* can be applied to other snow guard tubes that use an infrared heating element, such as infrared LEDs or infrared quartz heating tubes. For example, the coating 52*f* can be applied to snow guard tubes 62, 72, 82, 92, of FIGS. 11, 22, 30, and 40 respectively.

As described for FIGS. 40-43, the inventor discovered that he could mix strings of infrared LEDs with a visible light source, such as visible light emitting LEDs, to create a snow guard that was both heated and could display words and patterns. The infrared LEDs can be arranged so they heat the tube by both waste heat conduction and by infrared radiation. The visible light emitting LEDs can be arranged so they shine light through the cutouts in the shape of symbols, patterns, or words. This concept can be applied to the snow guard assemblies 50, 60, 70, 80, of FIGS. 1, 11, 22, 30, respectively.

While the snow guard assemblies 50, 60, 70, 80, 90 of FIGS. 1, 11, 22, 30, and 40, respectively are illustrated as standalone systems, they can be integrated with other rooftop systems. For example, the inventor envisions that the snow guard assemblies can act as both snow guard as well as conduit for a heating element. For example, the snow guard and gutter deicing system can share a heating element that the snow guard routes to the gutter deicing system.

While the examples and variations are helpful to those skilled in the art in understanding the claimed invention, the scope of the claimed invention is defined solely by the following claims and their equivalents.

The claims that follow are not to be interpreted as including means-plus-function limitations unless a claim explicitly evokes the means-plus-function clause of 35 USC § 112(f) by using the phrase "means for" followed by a verb in gerund form.

"Optional" or "optionally" is used throughout this disclosure to describe features or structures that are optional. Not using the word optional or optionally to describe a feature or structure does not imply that the feature or structure is essential, necessary, or not optional. Discussing advantages of one feature over another does not imply that that feature is essential. Using the word "or," as used in this disclosure is to be interpreted as the Boolean meaning of the word "or" (i.e., an inclusive or) For example, the phrase "A or B" can mean: A without B, B without A, A with B. For example, if one were to say, "I will wear a waterproof jacket if it snows or rains," the meaning is that the person saying the phrase intends to wear a waterproof jacket if it rains alone, if it snows alone, if it rains and snows in combination.

What is claimed is:

1. A snow guard assembly for attaching to a roof, comprising:

a snow guard tube extending above the roof and including a hollow interior;

a heating element including an infrared light source positioned within the snow guard tube;

the snow guard tube includes an interior surface that is opaque to visible light; and the infrared light source is arranged to radiate infrared light onto the interior surface.

2. The snow guard assembly of claim 1, wherein:

the infrared light source comprises one or more infrared light emitting diodes.

3. The snow guard assembly of claim 1, wherein:

the infrared light source is arranged to dissipate waste heat by conduction onto the snow guard tube.

4. The snow guard assembly of claim 1, wherein:

the snow guard tube is length-wise separable into a first tube portion and a second tube portion and includes an enclosed perimeter surface;

the first tube portion includes a backstop; and the backstop extends above the enclosed perimeter surface and extends length-wise along the snow guard tube.

5. The snow guard assembly of claim 4, wherein:

the first tube portion includes a flange extending parallel to the roof and beyond the enclosed perimeter surface.

6. The snow guard assembly of claim 4, wherein:

the first tube portion shaped and arranged to project length-wise along an L-shaped cross section; and the L-shaped cross section includes a first tube portion bottom area forming a first leg of the L-shaped cross section and the backstop extending upward from the first tube portion bottom area and forming a second leg of the L-shaped cross section.

7. A snow guard assembly for attaching to a roof, comprising:

a snow guard tube extending above the roof and including a hollow interior;

a heating element including an infrared light source positioned within the snow guard tube;

the snow guard tube includes an interior surface that is opaque to infrared light emitted by the infrared light source; and the infrared light source is arranged to radiate infrared light onto the interior surface.

8. The snow guard assembly of claim 7, wherein:

the infrared light source is arranged to dissipate waste heat by conduction onto the snow guard tube.

9. The snow guard assembly of claim 7, wherein:

the snow guard tube is length-wise separable into a first tube portion and a second tube portion and includes an enclosed perimeter surface;

the first tube portion includes a backstop; and the backstop extends above the enclosed perimeter surface and extends length-wise along the snow guard tube.

10. The snow guard assembly of claim 9, wherein:

the first tube portion includes a flange extending parallel to the roof and beyond the enclosed perimeter surface.

11. The snow guard assembly of claim 9, wherein:

the first tube portion arranged and shaped to project length-wise along an L-shaped cross section; and the L-shaped cross section includes a first tube portion bottom area forming a first leg of the L-shaped cross section and the backstop extending upward from the first tube portion bottom area and forming a second leg of the L-shaped cross section.

12. A snow guard assembly for attaching to a roof, comprising:

a snow guard tube extending above the roof;

a heating element positioned within the snow guard tube;

the snow guard tube includes a shape cut through the snow guard tube; and a visible light source positioned within the snow guard tube and arranged to project light through the shape and form patterns on the roof.

13. The snow guard assembly of claim 12, wherein:

the heating element is an infrared light source.

14. The snow guard assembly of claim 12, wherein:

the heating element is an infrared light emitting diode.

15. The snow guard assembly of claim 12, further comprising:

a mounting bracket secured to the snow guard tube;

the mounting bracket projecting the snow guard tube above the roof;

a threaded fastener;

the snow guard tube includes a snow guard tube mounting portion extending length-wise along the snow guard tube;

the snow guard tube mounting portion includes length-wise grooves; and the threaded fastener secures the mounting bracket to the snow guard tube by threadedly engaging the length-wise grooves.

* * * * *